US009711909B2

(12) United States Patent
Lim et al.

(10) Patent No.: US 9,711,909 B2
(45) Date of Patent: Jul. 18, 2017

(54) ELECTRICAL CONNECTOR

(75) Inventors: Chin Hua Lim, Ang Mo Kio (SG); Saujit Bandhu, Anchorvale (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/111,782

(22) PCT Filed: Apr. 27, 2012

(86) PCT No.: PCT/US2012/035321
§ 371 (c)(1),
(2), (4) Date: Oct. 15, 2013

(87) PCT Pub. No.: WO2012/149233
PCT Pub. Date: Nov. 1, 2012

(65) Prior Publication Data

US 2014/0227911 A1 Aug. 14, 2014

(30) Foreign Application Priority Data

Apr. 28, 2011 (SG) ..... 201103086-3

(51) Int. Cl.
*H01R 13/6473* (2011.01)
*H01R 12/71* (2011.01)
*H01R 13/28* (2006.01)
*H01R 24/84* (2011.01)

(52) U.S. Cl.
CPC ..... *H01R 13/6473* (2013.01); *H01R 12/71* (2013.01); *H01R 12/716* (2013.01); *H01R 13/28* (2013.01); *H01R 24/84* (2013.01)

(58) Field of Classification Search
CPC ..... H01R 12/71; H01R 12/716; H01R 23/27; H01R 13/28; H01R 24/84
USPC ..... 439/660, 65, 284, 295, 74, 66, 767, 101, 439/55, 79
See application file for complete search history.

(56) References Cited

U.S. PATENT DOCUMENTS 5,098,311 A * 3/1992 Roath et al. ..... 439/295
5,161,985 A * 11/1992 Ramsey ..... H01R 12/716 439/284
5,498,167 A * 3/1996 Seto et al. ..... 439/74
(Continued)

FOREIGN PATENT DOCUMENTS

| | | |
|---|---|---|
| EP | 0 905 826 | 3/1999 |
| EP | 1 189 310 | 3/2002 |
| TW | M337167 | 7/2008 |

OTHER PUBLICATIONS

PCT International Search Report from PCT/US2012/035321 mailed on Sep. 19, 2012, 5 pages.

*Primary Examiner* — Amy Cohen Johnson
*Assistant Examiner* — Oscar C Jimenez
(74) *Attorney, Agent, or Firm* — Robert S. Moshrefzadeh

(57) ABSTRACT

An electrical connector (100) is disclosed. In a described embodiment, the electrical connector (100) comprises first and second terminal pairs (102, 104) configured to electrically couple to a same device, each terminal pair (102, 104) comprising terminals (102*a*, 102*b*, 104*a*, 104*b*), with the terminals (102*a*, 102*b*) in the first terminal pair (102) having different first and second electrical lengths and the terminals (104*a*, 104*b*) in the second terminal pair (104) having different third and fourth electrical lengths, wherein a sum of the first and third electrical lengths is substantially the same as a sum of the second and fourth electrical lengths.

34 Claims, 17 Drawing Sheets

(56) References Cited

U.S. PATENT DOCUMENTS

| | | | | |
|---|---|---|---|---|
| 5,915,976 | A | 6/1999 | McHugh | |
| 6,464,515 | B1 | 10/2002 | Wu | |
| 6,464,537 | B1 * | 10/2002 | Letourneau et al. | 439/607.14 |
| 6,702,590 | B2 * | 3/2004 | Zaderej et al. | 439/74 |
| 7,429,176 | B2 * | 9/2008 | Johnescu | H01R 13/506 439/74 |
| 7,442,054 | B2 * | 10/2008 | Lemke et al. | 439/79 |
| 7,513,798 | B2 * | 4/2009 | Smith | 439/607.05 |
| 8,075,323 | B2 * | 12/2011 | Okuyama et al. | 439/101 |
| 8,342,886 | B2 * | 1/2013 | Zhang et al. | 439/660 |
| 2002/0106932 | A1 * | 8/2002 | Holland et al. | 439/500 |
| 2003/0176110 | A1 * | 9/2003 | Wu | H01R 12/716 439/660 |
| 2008/0318452 | A1 | 12/2008 | Lin | |
| 2009/0068887 | A1 | 3/2009 | Ito | |
| 2009/0264023 | A1 | 10/2009 | Yi et al. | |
| 2012/0083155 | A1 * | 4/2012 | Minich | H01R 24/30 439/607.05 |
| 2012/0202363 | A1 * | 8/2012 | McNamara et al. | 439/74 |
| 2014/0203886 | A1 * | 7/2014 | Schumacher | 333/33 |

* cited by examiner

ELECTRICAL CONNECTOR

FIELD OF THE INVENTION

This invention relates to an electrical connector, particularly but not exclusively to a board-to-board connector.

BACKGROUND OF THE INVENTION

Conventional board-to-board electrical connectors and electrical connector assemblies are generally used in low-speed transmission applications whereby the amounts of cross talk (both near end and far end) and electromagnetic interference (EMI) are not critical.

However, in recent years, there has been a significant increase in the required data rate (in turn, the required rise time of signals) for several applications. In order to meet this increasing need for high-speed transmission, it is preferable to design electrical connectors and electrical connector assemblies such that these connectors and connector assemblies have superior performance over frequencies in the GHz range. Further, in line with an increasing demand for smaller and more compact devices, sizes of electrical connectors also have to be reduced correspondingly. It is a challenge to improve on the performance of electrical connectors and electrical connector assemblies while providing electrical connectors of sizes which meet certain technical requirements.

SUMMARY OF THE INVENTION

In a first aspect, there is provided an electrical connector comprising first and second terminal pairs configured to electrically couple to a same device, each terminal pair comprising terminals, with the terminals in the first terminal pair having different first and second electrical lengths and the terminals in the second terminal pair having different third and fourth electrical lengths, wherein a sum of the first and third electrical lengths is substantially the same as a sum of the second and fourth electrical lengths.

Preferably, the terminals in at least one of the first and second terminal pairs have different longitudinal profiles.

Alternatively, at least one terminal in the first pair of terminals may have a different longitudinal profile than at least one terminal in the second pair of terminals.

Optionally, terminating ends of the terminals in the first pair of terminals face away from terminating ends of the terminals in the second pair of terminals.

Advantageously, a difference between the sum of the first and third electrical lengths and the sum of the second and fourth electrical lengths may be less than 5%.

As discussed in the described embodiment, by providing terminals having different longitudinal profiles, lengths and/or electrical lengths, this enables flexibility in arranging the terminals which may result in achieving reduced height/size of the electrical connector. Although the differences in the terminals may lead to timing offsets in signals carried by the terminals, when the electrical connector is mated with a like electrical connector, the similarity between the sum of the first and third electrical lengths, and the sum of the second and fourth electrical lengths helps to overcome these timing offsets.

"Like electrical connectors" or "like connectors" are defined in this document as electrical connectors having like functional portions performing the same function. Specifically in the described embodiments, the functional portions relate to the terminals of the electrical connector. Of course, this also means that like connectors may be exactly the same as each other.

Preferably, each terminal pair has an impedance mismatch of at least 10% and is configured to mate with a complementary terminal pair of a like electrical connector, the mating of the two connectors resulting in a plurality of mated terminal pairs, each mated terminal pair having a mated impedance mismatch of less than about 5%. The impedance mismatch of each terminal pair may be at least 15% whereas the mated impedance mismatch may be less than about 3%.

In a second aspect, there is provided an electrical connector comprising a plurality of terminal pairs, each terminal pair comprising terminals and having an impedance mismatch of at least 10% and being configured to mate with a complementary terminal pair of a like electrical connector, the mating of the two connectors resulting in a plurality of mated terminal pairs, each mated terminal pair having a mated impedance mismatch of less than about 5%. The impedance mismatch of each terminal pair may be at least 15% whereas the mated impedance mismatch may be less than about 3%.

The reduced impedance mismatch when the electrical connector is mated with a like electrical connector as discussed in the described embodiments helps to reduce losses and improve the performance of the electrical connector assembly formed by the mated electrical connectors.

In a third aspect, there is provided an electrical connector comprising: a plurality of terminal pairs, each terminal pair comprising terminals of different longitudinal profiles; wherein each terminal pair is configured to mate with a complementary terminal pair of a like electrical connector to allow electrical signal transmission.

Each terminal pair may be configured to carry differential signals. Preferably, the terminals of each terminal pair have different lengths. More preferably, difference in the lengths of the terminals of each terminal pair ranges from 0.05 mm to 0.2 mm.

As discussed above and in the described embodiment, by providing terminals having different longitudinal profiles, lengths and/or electrical lengths, this enables flexibility in arranging the terminals which may result in achieving reduced height/size of the electrical connector.

Preferably, each of the terminals of each terminal pair includes a terminal body having a terminating portion for connecting to a circuit board, a mating portion for mating to the complementary terminal pair of the like connector, and a step portion joining the terminating portion to the mating portion.

The step portion of each terminal of the electrical connector in the described embodiments is useful as it can be varied to achieve the difference in the longitudinal profiles, lengths and/or electrical lengths of the terminals of each terminal pair.

Preferably, the step portions of the terminals of said terminal pair have different heights to create the different longitudinal profiles.

The mating portion may have an arcuate shape or may be elongate.

Preferably, the terminals of each terminal pair are at least partially housed in respective retention channels of the connector, the respective retention channels being arranged to overlap at least partially with each other.

Using overlapping retention channels for housing the respective terminals as discussed in the described embodiments optimizes the space available in the electrical connector. This helps to reduce the height and size of the electrical connector.

Preferably, the terminals of each terminal pair are edge-coupled.

As discussed in the described embodiments, arranging the terminals of each terminal pair to be edge-coupled increases the surface areas of the contacting surfaces between the terminals of the electrical connector and complementary terminals of a like electrical connector when the electrical connectors are mated together.

Preferably, the electrical connector further comprises a plurality of ground shields, each ground shield interleaving adjacent terminal pairs. More preferably, each ground shield is arranged to at least partially shield the terminal bodies of the adjacent terminal pairs the ground shield interleaves.

Ground shields in the described embodiments help to reduce the amount of cross-talk, in other words, provide a high cross-talk performance (both near end and far end). This allows adjacent terminal pairs to be arranged nearer to each other, hence further reducing the size of the electrical connector. Also, with the ground shields in the described embodiments, the need for row shields is eliminated and the electrical connector is able to achieve superior performance for signals in the GHz frequency range and is able to work as a high-speed electrical connector in the Giga bits range. This allows the electrical connector to be used in many drives which require high speeds.

The terminal pairs may be arranged along a plurality of rows. Preferably, the plurality of rows comprises two parallel rows.

In a fourth aspect, there is provided an electrical connector assembly comprising: first and second electrical connectors for coupling to respective circuit boards, each electrical connector comprising a plurality of terminal pairs, each terminal pair comprising terminals of different electrical lengths; wherein the first electrical connector is stackable with the second electrical connector to enable the terminals of the first electrical connector to mate with corresponding terminals of the second electrical connector; and wherein the mated terminals have substantially same electrical lengths.

Each terminal pair of the first and second electrical connectors may be configured to carry differential signals.

The terminals of each terminal pair of each electrical connector may have different longitudinal profiles, wherein the combined longitudinal profiles of the mated terminals are configured to create the substantially same electrical lengths.

Although in the described embodiments, the different longitudinal profiles, lengths and/or electrical lengths of the terminals of the electrical connector enable flexibility in arranging the terminals, they often lead to timing offsets in the signals carried by the terminals. This problem is especially important if the terminals are configured to carry differential signals. Nevertheless, the electrical connector in the described embodiments is configured to mate with a like electrical connector such that the mated terminals have substantially same electrical lengths. This thus overcomes the problem of the timing offsets in the signals.

In a fifth aspect, there is provided an electrical connector assembly comprising: first and second electrical connectors for coupling to respective circuit boards, the first electrical connector having a first maximum height and the second electrical connector having a second maximum height; wherein the first and second electrical connectors are like connectors, and wherein the first electrical connector is stackable with the second electrical connector to form the electrical connector assembly, the electrical connector assembly having a maximum stack height less than a sum of the first and second maximum heights.

As discussed in the described embodiments, by forming an electrical connector assembly with two electrical connectors stackable with each other such that the electrical connector assembly has a maximum stack height less than a sum of the maximum heights of the two electrical connectors, the height/size of the electrical connector assembly may be reduced.

In a sixth aspect, there is provided an electrical connector comprising: a plurality of terminal pairs, each terminal pair comprising terminals of different longitudinal profiles; a plurality of ground shields, each ground shield interleaving adjacent terminals; wherein each terminal pair is configured to mate with a complementary terminal pair of a like electrical connector to allow electrical signal transmission; and wherein each of the plurality of terminals comprises a terminal body having a terminating portion for connecting to a circuit board, a mating portion for mating to the complementary terminal of the like electrical connector, and a step portion joining the terminating portion to the mating portion.

As discussed above and in the described embodiments, providing terminals of different longitudinal profiles, lengths and/or electrical lengths help to increase the flexibility in arranging the terminals which may result in a reduced height/size of the electrical connector. The step portion of each terminal in the described embodiments is useful as it can be varied to achieve the difference in the longitudinal profiles of the terminals. Furthermore, ground shields help to reduce the amount of cross-talk and the adjacent terminals may be arranged closer to each other, further reducing the size of the electrical connector. With the ground shields, the electrical connector is able to achieve superior performance for signals in the GHz frequency range and is able to work as a high-speed electrical connector in the Giga bits range.

The plurality of terminal pairs may be arranged along a plurality of rows. Preferably, the plurality of rows comprises two parallel rows.

In a seventh aspect, there is provided an electrical connector comprising: a first set of terminals and a second set of terminals having different longitudinal profiles as the first set of terminals; wherein each terminal is configured to mate with a complementary terminal of a like electrical connector to allow electrical signal transmission.

As discussed above and in the described embodiments, by providing terminals having different longitudinal profiles, lengths and/or electrical lengths, this enables flexibility in arranging the terminals which may result in achieving reduced height/size of the electrical connector.

The electrical connector according to any aspect of the present invention may be a board-to-board connector. Preferably, a stack height of the electrical connector according to any aspect of the present invention is less than 4 mm. More preferably, the stack height of the electrical connector according to any aspect of the present invention is less than 1 mm.

The low stack height of the electrical connector in the described embodiments allows the lengths (and thus, very often, electrical lengths) of the terminals of the electrical connector to be reduced, increasing the speed of transmission of signals. Furthermore, many drives currently manufactured by several solid state drive makers have significant space constraints. With the low stack height of the electrical connector in the described embodiments, the electrical connector is able to overcome such space constraints.

BRIEF DESCRIPTION OF THE FIGURES

Embodiments of the invention will now be illustrated by way of example with reference to the following drawings, in which.

DETAILED DESCRIPTION OF THE EMBODIMENTS

Figure 1A:
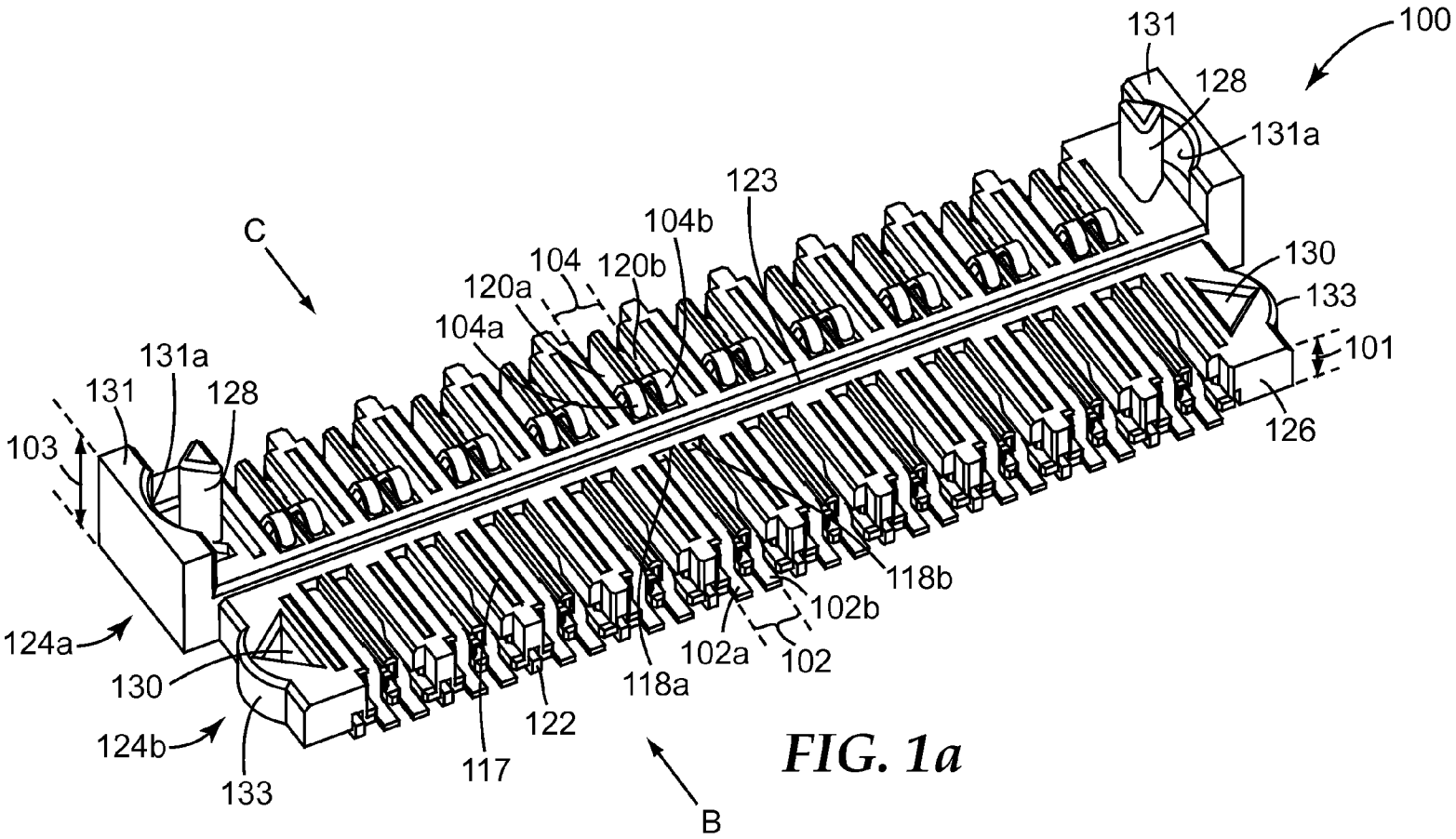
FIG. 1*a* illustrates a first perspective view of an electrical connector according to a preferred embodiment of the present invention.
Figure 2:
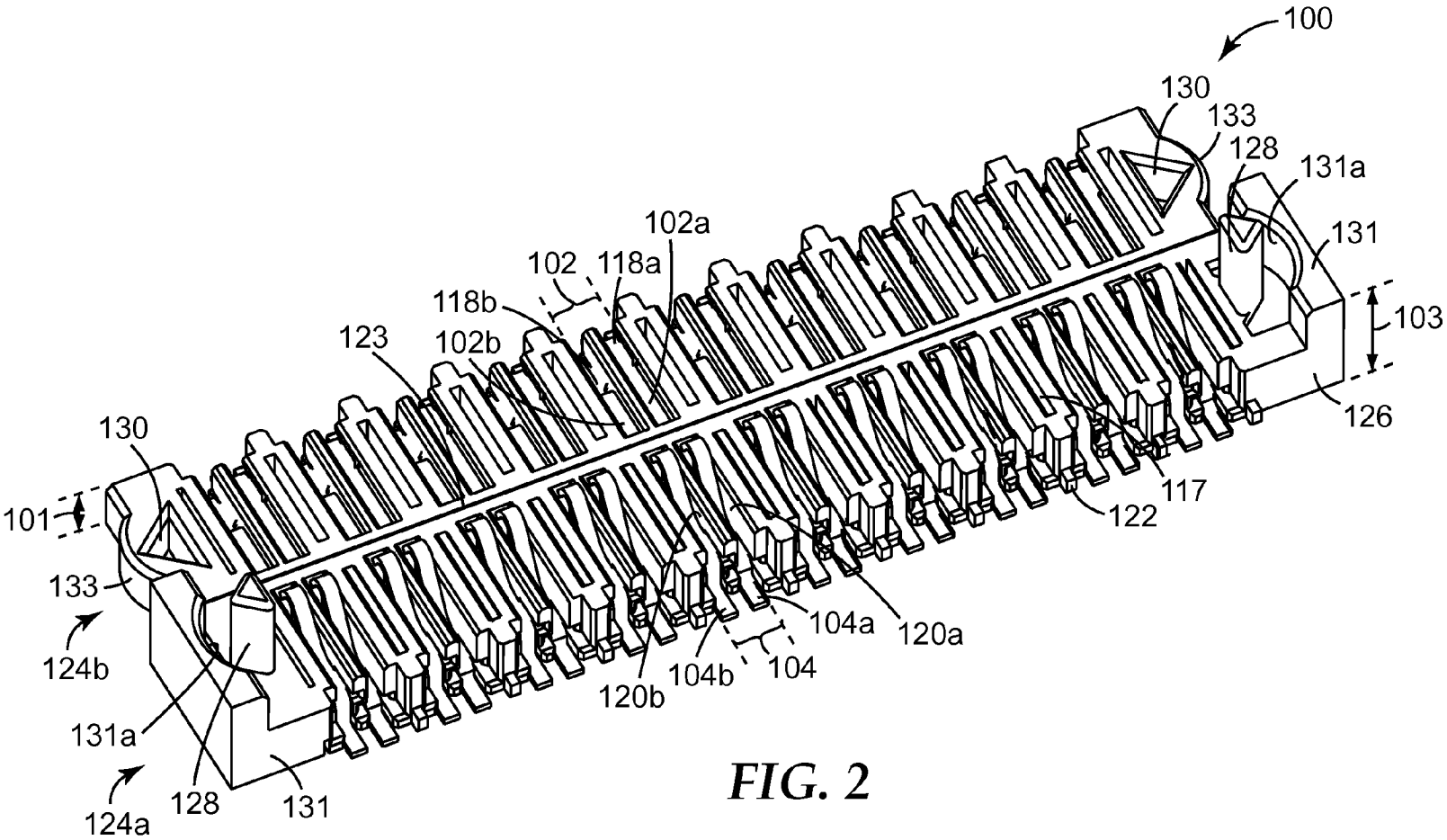
FIG. 2 illustrates a second perspective view of the electrical connector of FIG. 1*a;*

FIG. 1*a* illustrates a first perspective view of an electrical connector 100 according to a preferred embodiment of the present invention whereas FIG. 2 illustrates a second perspective view of the electrical connector 100. The electrical connector 100 is hermaphroditic and serves as a low-profile high speed board-to-board connector. By "low-profile", it means that the electrical connector 100 has a stack height 101 of less than 4 mm and by "high speed", it means that the electrical connector 100 is capable of carrying signals with data rate of 1 Gigabit/second or more.

As shown in FIGS. 1*a* and 2, the electrical connector 100 comprises a plurality of terminal pairs 102, 104 with each terminal pair 102, 104 configured to carry differential signals. More specifically, the electrical connector 100 comprises a first terminal pair 102 comprising terminals 102*a*, 102*b* and a second terminal pair 104 comprising terminals 104*a*, 104*b*. The terminals 102*a*, 102*b*, 104*a*, 104*b* of each terminal pair 102, 104 are edge-coupled and are made using a stamp and form process which allows the terminals 102*a*, 102*b*, 104*a*, 104*b* to be deflected more easily and to have lower heights. By "edge-coupled", it means that edges (instead of surfaces) of the terminals 102*a*, 102*b*, 104*a*, 104*b* of each terminal pair 102, 104 are arranged to face each other. Furthermore, the first and second terminal pairs 102, 104 are configured to be coupled electrically to a same device.

The electrical connector 100 also comprises a plurality of ground shields 122, and an elongate housing 126 which is configured to receive the plurality of terminal pairs 102, 104 and the plurality of ground shields 122 along its length. The plurality of ground shields 122 may be made of metal or any other conductive material.

Referring to FIGS. 1*a* and 2, the housing 126 further comprises a centre rib member 123 which extends between the two ends of the housing 126 and along the length of the housing 126. The housing 126 also comprises a plurality of elongate retention channels 118*a*, 118*b*, 120*a*, 120*b* which extends on either side of the rib member 123 so that the retention channels 118*a*. 118*b*, 120*a*, 120*b* form first and second parallel rows 124*a*, 124*b* along the length of the housing 126. The plurality of retention channels 118*a*, 118*b*, 120*a*, 120*b* is configured to hold the terminals 102*a*, 102*b*, 104*a*, 104*b* of the terminal pairs 102, 104 and is arranged in pairs, with each pair configured to hold one of the terminal pairs 102, 104. In addition, the housing 126 comprises a plurality of retention members 117 configured to hold the ground shields 122. The retention members 117 and retention channels 118*a*, 118*b*, 120*a*, 120*b* are arranged side by side with each retention member 117 interleaving adjacent pairs of retention channels 118*a*, 118*b*, 120*a*, 120*b*. In addition, the retention members 117 and retention channels 118*a*, 118*b*, 120*a*, 120*b* are arranged along the two rows 124*a*, 124*b* which are parallel to each other and along the length of the centre rib member 123. In other words, the plurality of terminal pairs 102, 104 (arranged to be held by the retention channels 118*a*, 118*b*, 120*a*, 120*b*) are also arranged along the two rows 124*a*, 124*b* which are parallel to each other and along the length of the centre rib member 123. Furthermore, the retention members 117, together with the ground shields 122, are arranged to extend across a breadth of the housing 126 through the centre rib member 123 whereas the retention channels 118*a*, 118*b*, 120*a*, 120*b*, together with the terminal pairs 102, 104, are arranged to extend from the centre rib member 123, with lengths of the retention channels 118*a*, 118*b*, 120*a*, 120*b* and the terminal pairs 102, 104 orthogonal to the length of the centre rib member 123.

At each end of the housing 126, the housing 126 comprises a male engagement member in the form of an upstanding post 128 which has a triangular cross-section and a corresponding female engagement member in the form of a triangular engagement hole 130 arranged adjacent to the post 128. The housing 126 further comprises a raised end element 131 at each end of the first row 124*a* next to the respective upstanding post 128. Each raised end element 131 of the first row 124*a* comprises a raised portion extending above heights of the retention channels 118*a*, 118*b*, 120*a*, 120*b*. Furthermore, as shown in FIGS. 1*a* and 2, each raised end element 131 comprises a convex surface 131*a* on its raised portion.

Also shown in FIGS. 1*a* and 2, each of the ends 133 of the housing 126 corresponding to the second row 124*b* has a concave surface, and the purpose of this will be elaborated in further detail later. A maximum height 103 of the electrical connector 100 is defined as a distance between two furthest points along a height of an end of the housing 126 which, in this embodiment, is also the same as a height of one of the raised end elements 131 in FIG. 1*a*. The stack height 101 is defined as a height of the retention channels 118*a*, 118*b*, 120*a*, 120*b* of the housing 126.

Figure 1B:
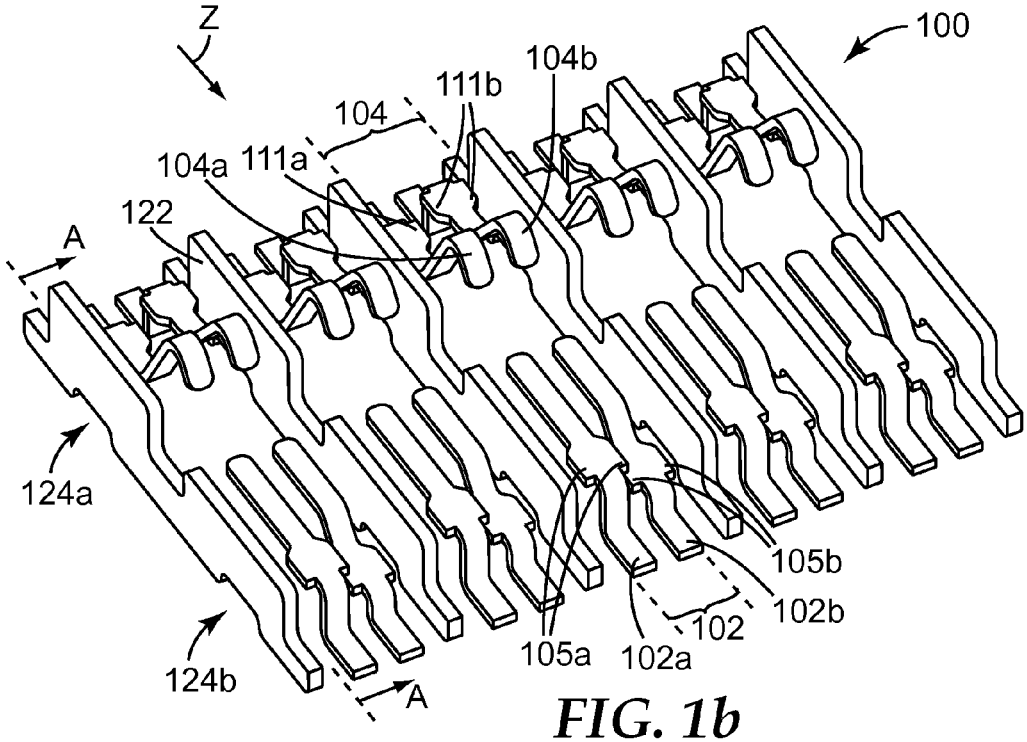
FIG. 1*b* illustrates a perspective view of a part of the electrical connector of FIG. 1*a* without showing a housing of the electrical connector.

FIG. 1*b* illustrates a perspective view of a part of the electrical connector 100 without showing the housing 126. As shown in FIG. 1*b*, the terminals 102*a*, 102*b*, 104*a*, 104*b* of each terminal pair 102, 104 have different longitudinal profiles and different lengths although they may be considered to have broadly similar shapes. The difference in the lengths of the terminals 102*a*, 102*b*, 104*a*, 104*b* of each terminal pair 102, 104 ranges from 0.05 mm to 0.2 mm. The electrical lengths of the terminals 102*a*, 102*b*, 104*a*, 104*b* of each terminal pair 102, 104 are also different. More specifically, the terminals 102*a*, 102*b* of the first terminal pair 102 have different first and second electrical lengths whereas the terminals 104*a*, 104*b* of the second terminal pair 104 have different third and fourth electrical lengths. Furthermore, the longitudinal profiles and lengths of the terminals 102*a*, 102*b* of the first terminal pair 102 are different from the longitudinal profiles and lengths of the terminals 104*a*, 104*b* of the second terminal pair 104. Also, as shown in FIG. 1*b*, each terminal 102*a*, 102*b*, 104*a*, 104*b* comprises wing elements 105*a*, 105*b*, 111*a*, 111*b* for engagement with the retention channels 118*a*, 118*b*, 120*a*, 120*b* of the housing 126 (as will be elaborated later with reference to FIGS. 3*a*, 3*b*, 3*c*, 4*a*, 4*b* and 4*c*). Furthermore, each ground shield 122 interleaves adjacent terminal pairs 102, 104 and the ground shields 122 are broadside coupled to each other (i.e. surfaces of the ground shields 122 are arranged to face each other).

Figure 8A:
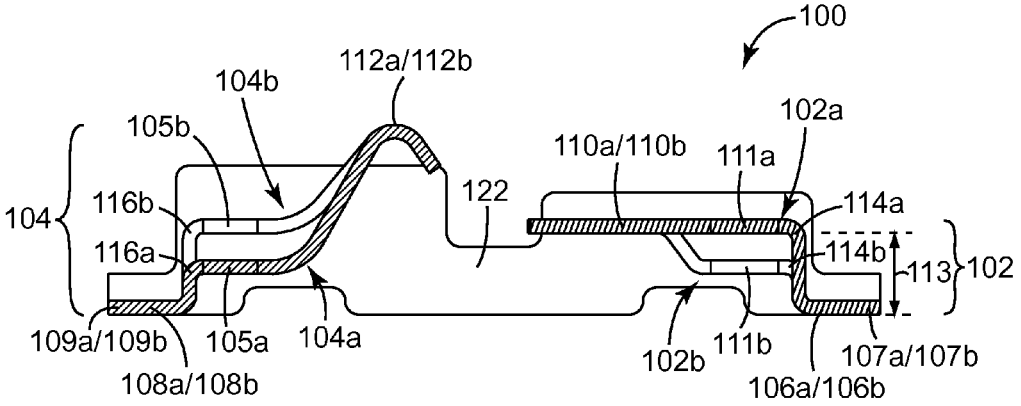
FIG. 8*a* illustrates a cross-sectional enlarged side view of the electrical connector of FIG. 1*b* in the direction 'AA'.

FIG. 8*a* illustrates a cross-sectional enlarged side view of the electrical connector 100 without showing the housing 126 as viewed from direction 'AA' in FIG. 1*b*. As shown in FIG. 8*a*, each of the terminals 102*a*, 102*b* of the first terminal pair 102 includes a terminal body having a terminating portion 106*a*, 106*b*, a mating portion 110*a*, 110*b* and a step portion (or step down mid-portion) 114*a*, 114*b* which links the terminating portion 106*a*, 106*b* to the mating portion 110*a*, 110*b*. Similarly, each of the terminals 104*a*, 104*b* of the second terminal pair 104 includes a terminal body having a terminating portion 108*a*, 108*b*, a mating portion 112*a*, 112*b* and a step portion 116*a*, 116*b* which links the terminating portion 108*a*, 108*b* to the mating portion 112*a*, 112*b*. Note that the mating portions 110*a*, 110*b* of the terminals 102*a*, 102*b* are separate and spaced apart although they are shown as overlapping each other in FIG. 8*a*. The same applies for the terminating portions 106*a*, 106*b* of the terminals 102*a*, 102*b*, the mating portions 112*a*, 112*b* of the terminals 104*a*, 104*b* and the terminating portions 108*a*, 108*b* of the terminals 104*a*, 104*b*. A step height 113 of the electrical connector 100 is defined as a height of the step portion 114*a* of the terminal 102*a* of the first terminal pair 102 which, in this embodiment, is also the same as a height between the mating portion 110*a* and the terminating portion 106*a* of the terminal 102*a*.

The terminating portions 106*a*, 106*b*, 108*a*, 108*b* of the terminals 102*a*, 102*b*, 104*a*, 104*b* are configured to be soldered to a same device such as a circuit board (for example, a Printed Circuit Board (PCB)). The terminating portions 106*a*, 106*b*, 108*a*, 108*b* respectively include terminating ends 107*a*, 107*b*, 109*a*, 109*b* whereby the terminating ends 107*a*, 107*b* of the terminals 102*a*, 102*b* of the first terminal pair 102 face away from the terminating ends 109*a*, 109*b* of the terminals 104*a*, 104*b* of the second terminal pair 104. The mating portions 110*a*, 110*b*, 112*a*, 112*b* of the terminals 102*a*, 102*b*, 104*a*, 104*b* are for mating to a complementary terminal pair of a like electrical connector. As shown in FIG. 8*a*, the mating portions 110*a*, 110*b* are elongate whereas the mating portions 112*a*, 112*b* are arcuate and resilient (with multiple durability cycles).

As shown in FIG. 8*a*, for each terminal pair 102, 104, the step portions 114*a*, 114*b*, 116*a*, 116*b* of the terminals 102*a*, 102*b*, 104*a*, 104*b* have different heights to create the different longitudinal profiles, different lengths and different electrical lengths. Also, each ground shield 122 is arranged to partially shield the terminal bodies of the adjacent terminal pairs 102, 104 it interleaves.

Figure 3A:
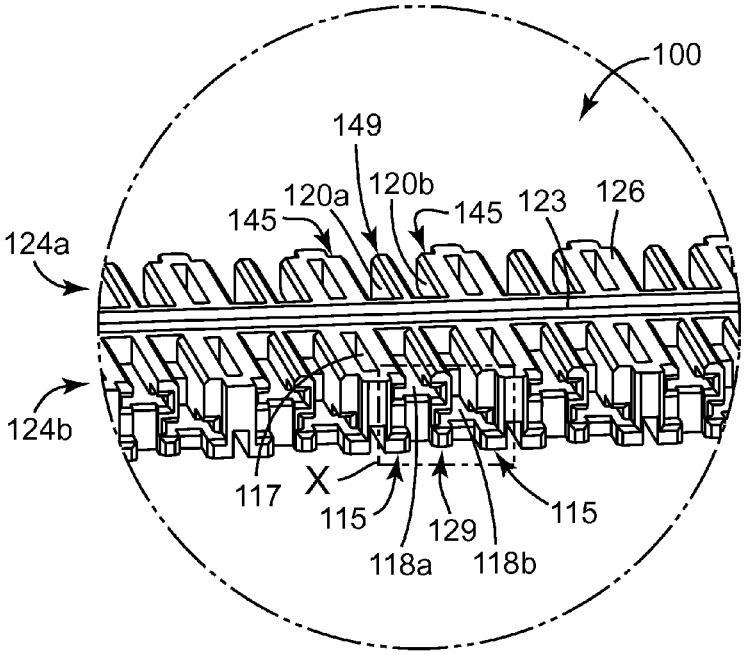
FIG. 3*a* and FIG. 3*b* respectively illustrate views of a first portion of the electrical connector of FIG. 1*a* from the direction 'B' without and with terminal pairs of the electrical connector.
Figure 3B:
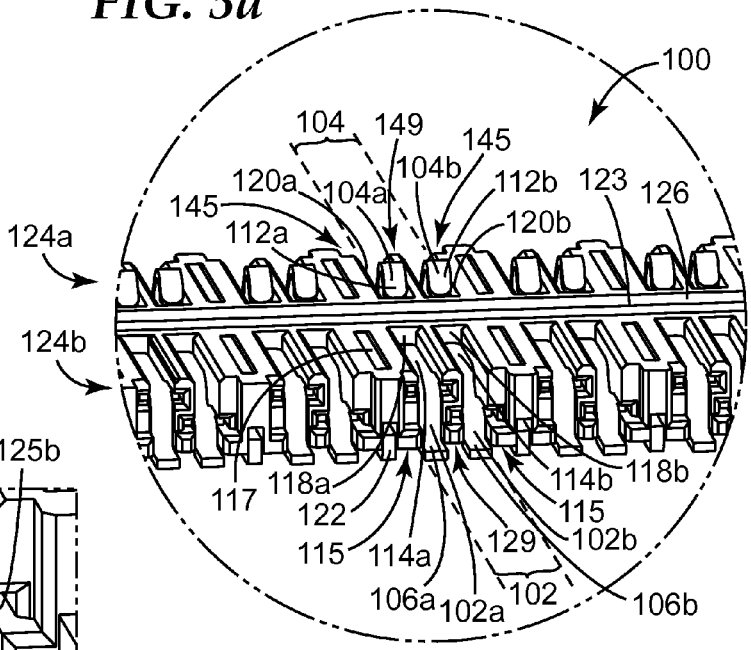
Figure 3C:
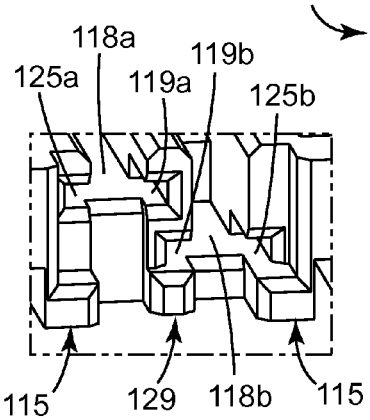
FIG. 3*c* is a magnified view of a portion X of FIG. 3*a;*
Figure 4A:
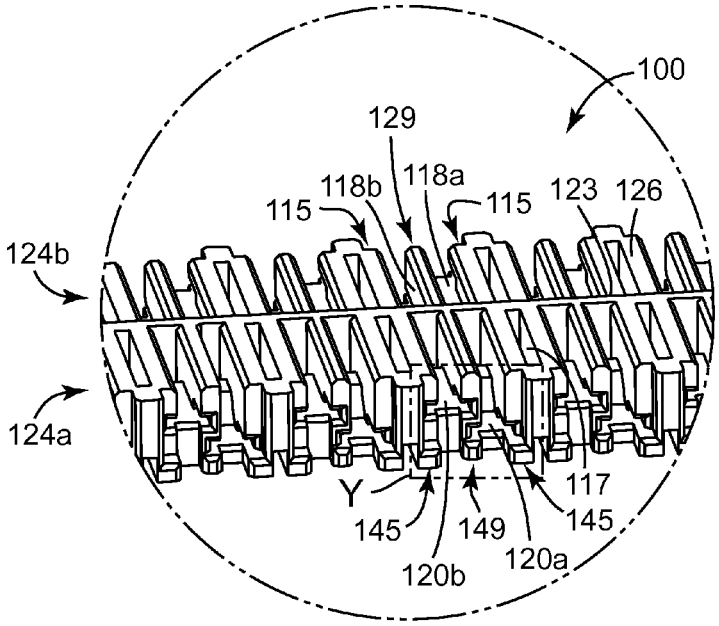
FIGS. 4*a* and 4*b* respectively illustrate views of the first portion of the electrical connector of FIG. 1*a* from the direction 'C' without and with the terminal pairs of the electrical connector.
Figure 4B:
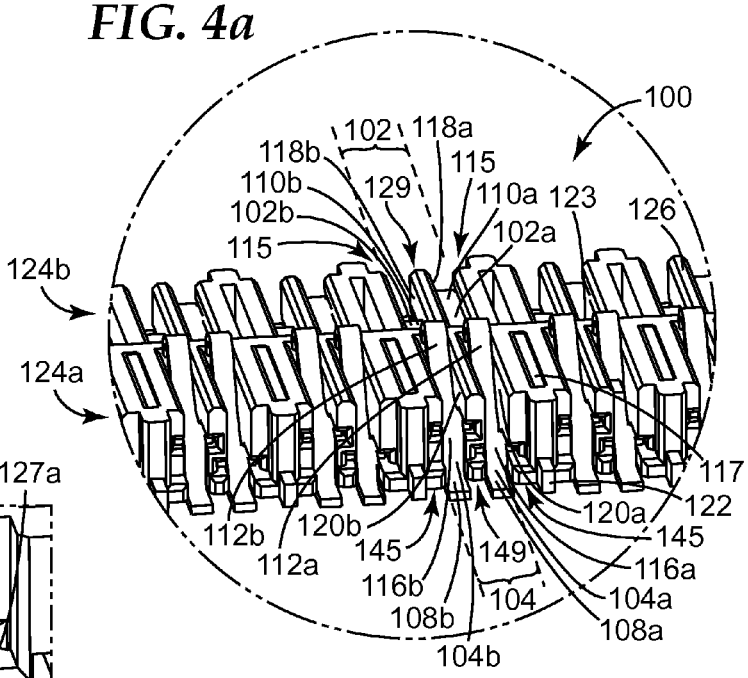

FIGS. 3*a* and 3*b* respectively illustrate views of a first portion of the electrical connector 100 from the direction 'B' in FIG. 1*a* without and with the plurality of terminal pairs 102, 104, and FIG. 3*c* is a magnified view of the portion 'X' of FIG. 3*a*. FIGS. 4*a* and 4*b* respectively illustrate views of the first portion of the electrical connector 100 from the direction 'C' in FIG. 1*a* without and with the plurality of terminal pairs 102, 104, and FIG. 4*c* is a magnified view of the portion 'Y' of FIG. 4*a*.

As shown in FIGS. 3*a*, 3*b*, 4*a* and 4*b*, the housing 126 comprises first walls 129, 149 and second walls 115, 145. The first walls 129, 149 interleave adjacent retention channels 118*a*, 118*b*, 120*a*, 120*b* of pairs of retention channels 118*a*, 118*b*, 120*a*, 120*b* whereas the second walls 115, 145, interleave each pair of retention channels 118*a*, 118*b*, 120*a*, 120*b* and neighboring retention members 117 holding the ground shields 122. Each retention channel 118*a*, 118*b*, 120*a*, 120*b* is formed between one of the first walls 129, 149 and one of the second walls 115, 145.

Figure 4C:
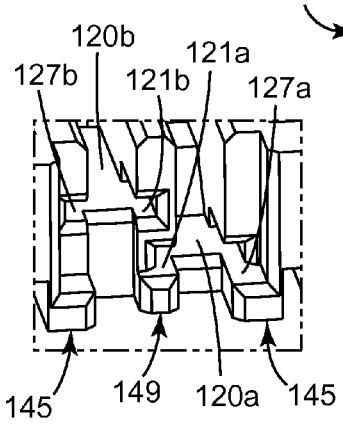
FIG. 4*c* is a magnified view of the portion Y of FIG. 4*a;*

Referring to the magnified views of the pairs of retention channels 118*a*, 118*b*, 120*a*, 120*b* of FIGS. 3*c* and 4*c*, the one of the first walls 129, 149 of each retention channel 118*a*, 118*b*, 120*a*, 120*b* comprises first gaps 119*a*, 119*b*, 121*a*, 121*b* whereas the one of the second walls 115, 145 of the retention channel 118*a*, 118*b*, 120*a*, 120*b* comprises second gaps 125*a*, 125*b*, 127*a*, 127*b*. The first and second gaps 119*a*, 119*b*, 125*a*, 125*b*, 121*a*, 121*b*, 127*a*, 127*b* are in the form of rectangular gaps.

Referring to the magnified view of the pair of retention channels 118*a*, 118*b* in FIG. 3*c*, the pair of retention channels 118*a*, 118*b* is offset with respect to each other such that the respective first gaps 119*a*, 119*b* overlap at least partially with each other. These first gaps 119*a*, 119*b* are aligned along the one of the first walls 129 interleaving the pair of retention channels 118*a*, 118*b*. Similarly, referring to the magnified view of the pair of retention channels 120*a*, 120*b* in FIG. 4*c*, the pair of retention channels 120*a*, 120*b* is offset with respect to each other such that the respective first gaps 121*a*, 121*b* overlap at least partially with each other. These first gaps 121*a*, 121*b* are also aligned along the one of the first walls 149 interleaving the pair of retention channels 120*a*, 120*b*.

The terminals 102*a*, 102*b*, 104*a*, 104*b* are coupled to the respective retention channels 118*a*, 118*b*, 120*a*, 120*b* by engaging the wing elements 105*a*, 105*b*, 111*a*, 111*b* of the terminals 102*a*, 102*b*, 104*a*, 104*b* with the first and second gaps 119*a*, 125*a*, 119*b*, 125*b*, 121*a*, 127*a*, 121*b*, 127*b* of the respective retention channels 118*a*, 118*b*, 120*a*, 120*b*. More specifically, the wing elements 105*a*, 105*b*, 111*a*, 111*b* of the terminals 102*a*, 102*b*, 104*a*, 104*b* are slotted into the first and second gaps 119*a*, 125*a*, 119*b*, 125*b*, 121*a*, 127*a*, 121*b*, 127*b* of the respective retention channels 118*a*, 118*b*, 120*a*, 120*b* to engage the terminals 102*a*, 102*b*, 104*a*, 104*b* with the respective retention channels 118*a*, 118*b*, 120*a*, 120*b*.

As shown in FIGS. 3*b* and 4*b*, the terminals 102*a*, 102*b* of the first terminal pair 102 are partially housed in the respective retention channels 118*a*, 118*b* whereas the terminals 104*a*, 104*b* of the second terminal pair 104 are partially housed in the respective retention channels 120*a*, 120*b*. To elaborate, while the mating portions 110*a*, 110*b*, 112*a*, 112*b* and the step portions 114*a*, 114*b*, 116*a*, 116*b* of the terminals 102*a*, 102*b*, 104*a*, 104*b* are completely housed in the respective retention channels 118*a*, 118*b*, 120*a*, 120*b*, part of the terminating portions 106*a*, 106*b*, 108*a*, 108*b* of the terminals 102, 104 lies outside the respective retention channels 118*a*, 118*b*, 120*a*, 120*b* to allow soldering of the electrical connector 100 to a circuit board. The ground shields 122 are also partially housed in the respective retention members 117.

FIGS. 6*a*-6*c*, 7*a* and 7*b* illustrate how an electrical connector assembly 600 is used to connect two circuit boards 602, 604 together so that signal transmission between the two circuit boards 602, 604 may be performed. The electrical connector assembly 600 comprises a first electrical connector in the form of the electrical connector 100 and a second electrical connector 200 which is exactly the same as (i.e. identical to) the electrical connector 100. Like parts of the second electrical connector 200 are designated by the same reference numerals, except that the reference numerals begin with a digit "2" instead of "1".

The terminating portions 106*a*, 106*b*, 108*a*, 108*b* of the first electrical connector 100 are first soldered to respective solder pads of the first circuit board 602 so that signals from the first circuit board 602 may be transmitted to the terminal pairs 102, 104. Note that the terminating portions 108*a*, 108*b* are not shown in FIG. 6*a*-6*c*, 7*a* or 7*b*. Likewise, the terminating portions (not shown in FIGS. 6*a*-6*c*, 7*a* or 7*b*) of the second electrical connector 200 are soldered to respective solder pads of the second circuit board 604 for the same purpose.

Figure 6A:
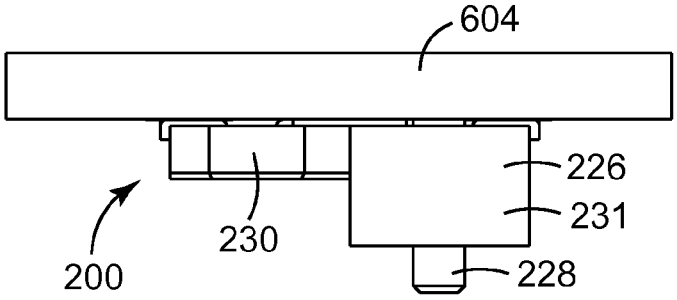
FIGS. 6*a* and 6*b* illustrate two electrical connectors of FIG. 1*a* connected to respective circuit boards with one of the electrical connectors inverted and FIG. 6*c* shows the two electrical connectors mated to form an electrical connector assembly to connect the two circuit boards together electrically.
Figure 6B:
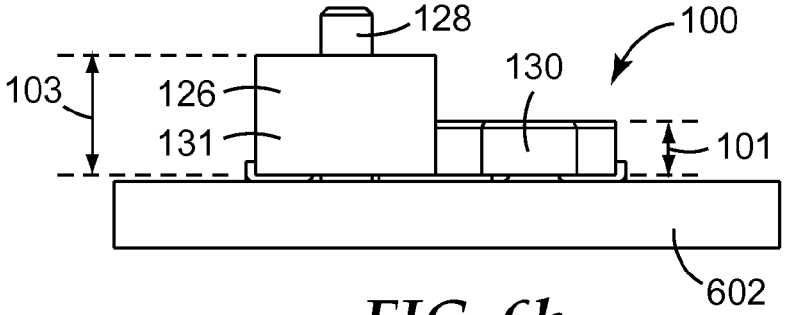
Figure 6C:
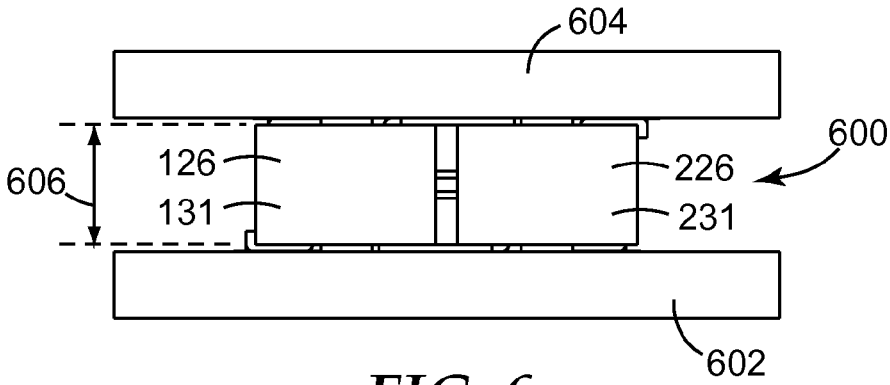
Figure 7A:
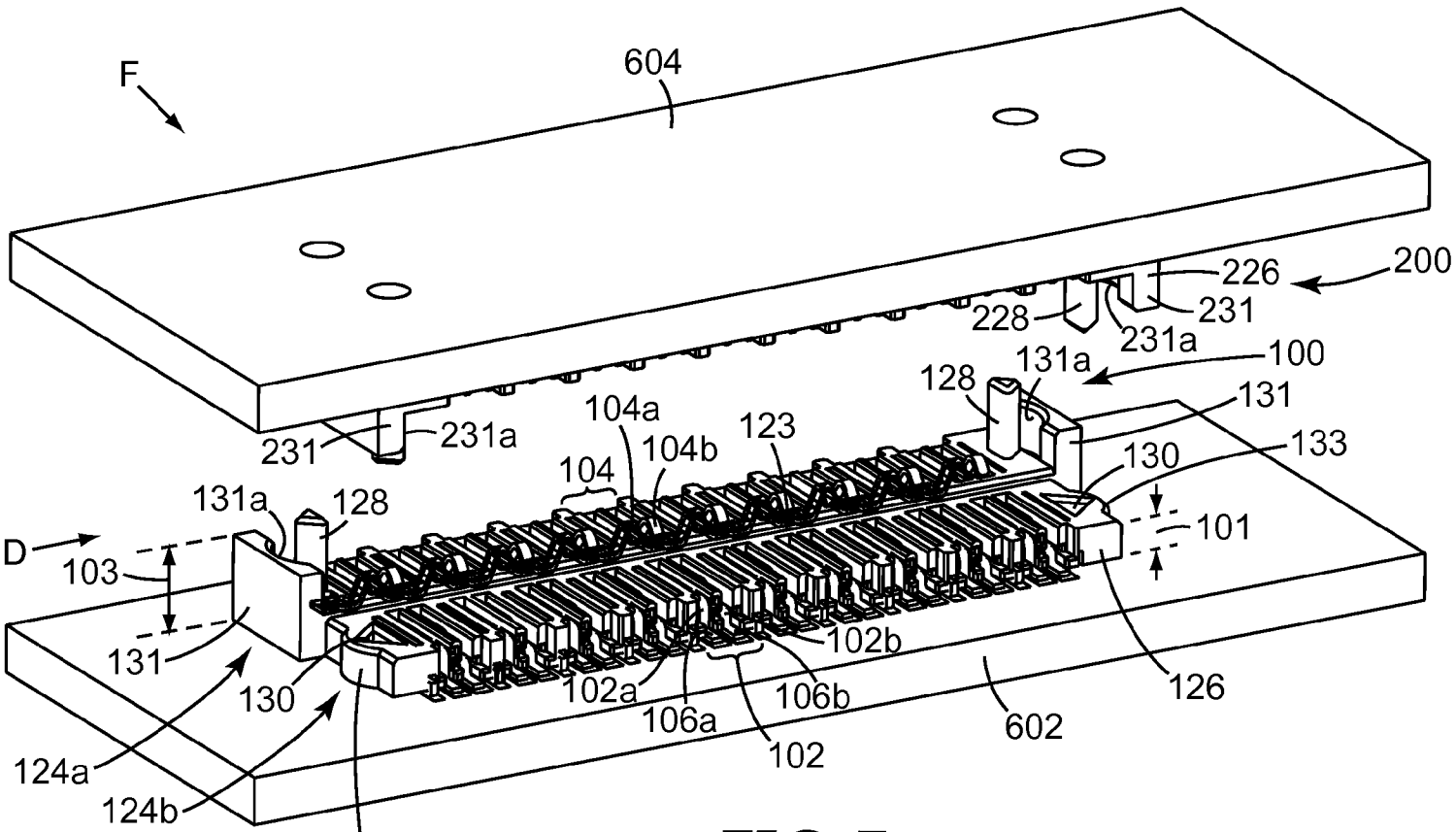
FIG. 7*a* illustrates perspective views of the electrical connectors of FIG. 6*a* and FIG. 6*b*.
Figure 7B:
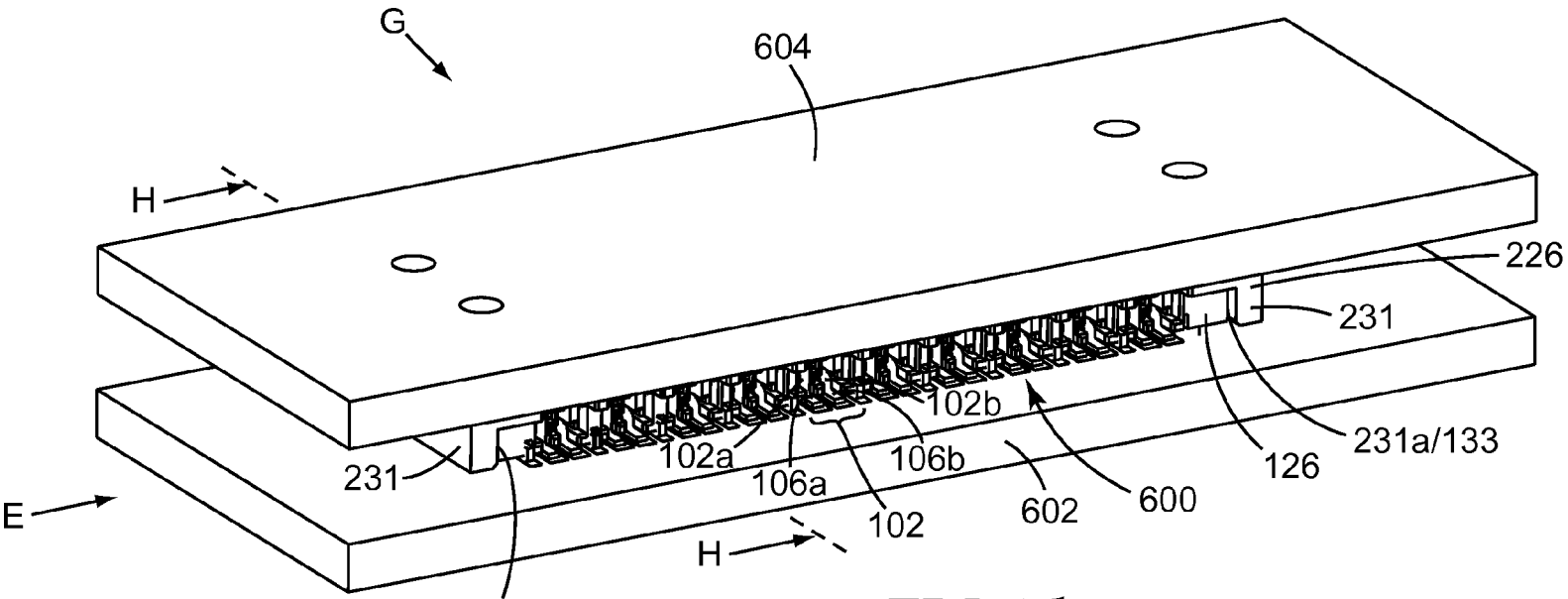
FIG. 7*b* is a perspective view of FIG. 6*c;*

In FIG. 7*a*, the two electrical connectors 100, 200 are shown apart whereas in FIG. 7*b*, the two electrical connectors 100, 200 are stacked together to form the electrical connector assembly 600. In FIGS. 6*a* and 6*b*, end views of the electrical connectors 100, 200 (from the direction "D" in FIG. 7*a*) are shown whereas in FIG. 6*c*, an end view of the electrical connector assembly 600 from the direction 'E' in FIG. 7*b* is shown.

In the stacked configuration of FIG. 6*c* and FIG. 7*b*, the terminals 102*a*, 102*b*, 104*a*, 104*b* of the terminal pairs 102, 104 of the electrical connector 100 are arranged to mate with corresponding terminals of corresponding terminal pairs of the second electrical connector 200 to form the electrical connector assembly 600. As more clearly shown in FIGS. 6*a*-6*c*, posts 228 and holes 230 of the second electrical connector 200 are respectively engaged with the holes 130 and the posts 128 of the electrical connector 100 when in the stacked configuration. Furthermore, as more clearly shown in FIGS. 7*a* and 7*b*, when the electrical connectors 100, 200 are mated together, the raised portions of the raised end elements 231 of the second electrical connector 200 are arranged to cooperate with concave ends 133 of the first electrical connector 100, with the convex surfaces 231*a* of the raised portions of the raised end elements 231 abutting the concave ends 133 of the first electrical connector 100. Similarly, raised portions of raised end elements 131 of the first electrical connector 100 are arranged to cooperate with the concave ends 233 of the second electrical connector 200, with convex surfaces 131*a* of the raised portions of the raised end elements 131 abutting the concave ends 233 of the second electrical connector 200. Further, referring to FIG. 6*b*, a maximum stack height 606 of the electrical connector assembly 600 is defined as a distance between furthest ends of the housings 126, 226 along a height of the mated pair of the electrical connectors 100, 200.

Figure 10A:
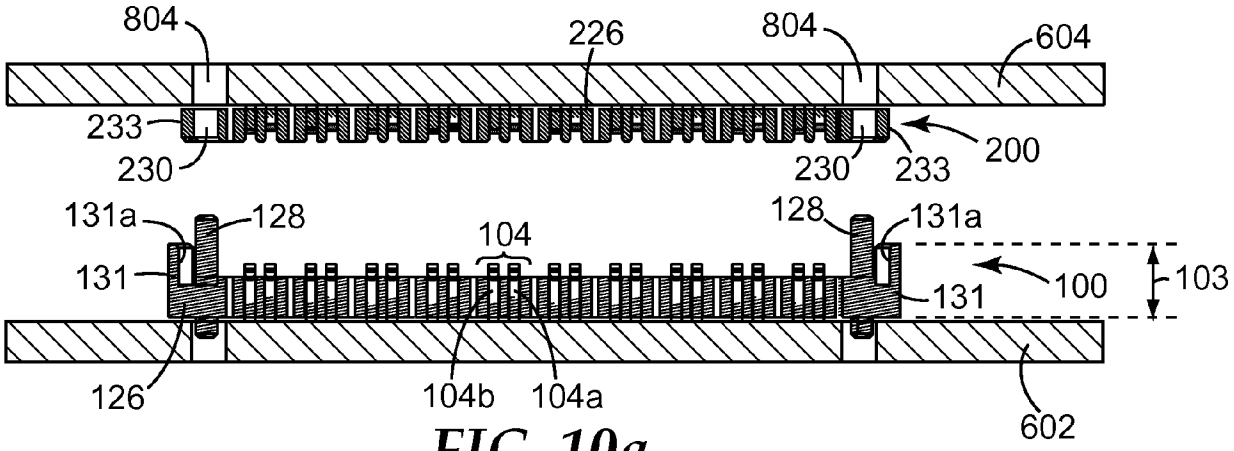
FIG. 10*a* illustrates side views of the electrical connectors of FIG. 7*a* from the direction 'F'.
Figure 10B:
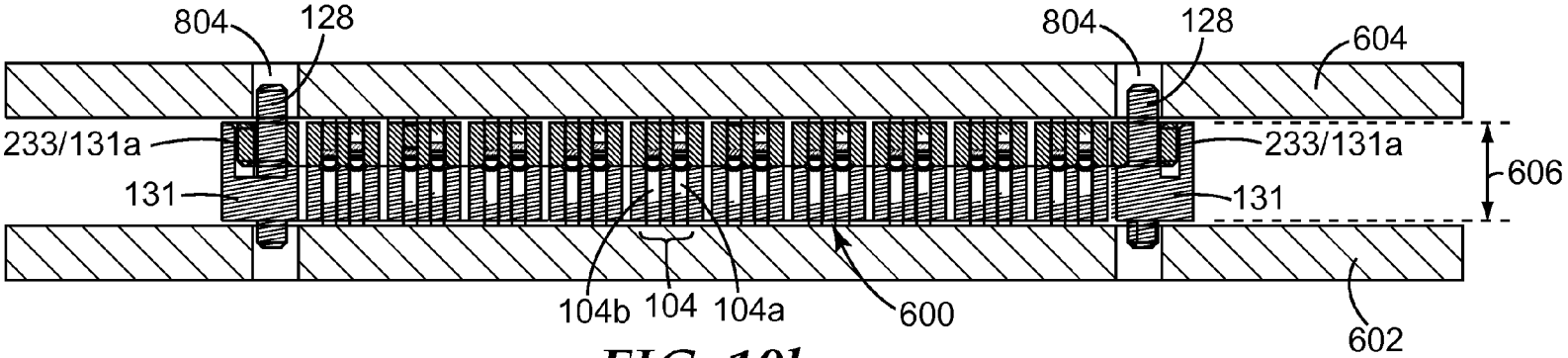
FIG. 10*b* illustrates a side view of the electrical connector assembly of FIG. 7*b* from the direction 'G'.

FIG. 10*a* illustrates side views of the electrical connectors 100, 200 from the direction 'F' in FIG. 7*a* whereas FIG. 10*b* illustrates a side view of the electrical connector assembly 600 from the direction 'G' in FIG. 7*b*.

Referring to FIGS. 10*a* and 10*b*, the electrical connector 100 has a first maximum height 103 of 'B'. Similarly, the second electrical connector 200, being exactly the same as the electrical connector 100 has a second maximum height of 'B'. As mentioned above, when the electrical connectors 100, 200 are mated together, the convex surfaces 131*a* of the raised end elements 131 of the electrical connector 100 are arranged to abut the concave ends 233 of the second electrical connector 200 whereas the convex surfaces 231*a* of the raised end elements 231 of the second electrical connector 200 are arranged to abut the concave ends 133 of the electrical connector 100 (the latter not shown in FIGS. 10*a* and 10*b*). In other words, the electrical connectors 100, 200 are mated in a nested configuration. As a result, the maximum stack height 606 of the electrical connector assembly 600 as shown in FIG. 10*b* is also 'B' which is less than a sum of the first 103 and second maximum heights ('2B'). Furthermore, the second circuit board 604 comprises holes 804 and the posts 128 of the electrical connector 100 are configured to extend through the holes 804 of the second circuit board 604 when the electrical connectors 100, 200 are mated. Note that the posts 228 of the second electrical connector 200 are not shown in FIGS. 10*a* and 10*b* to improve clarity of these figures.

Figure 8B:
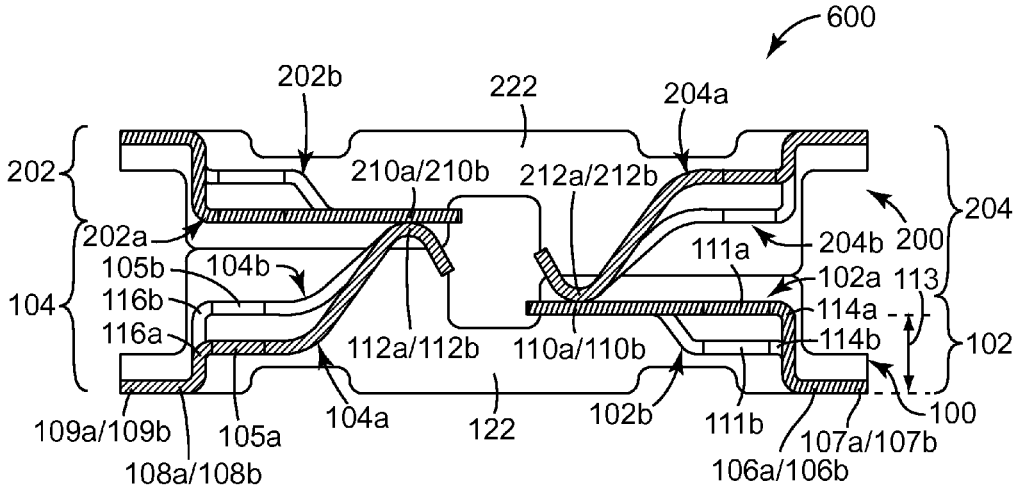
FIG. 8*b* illustrates a cross-sectional enlarged side view of the electrical connector assembly of FIG. 7*b* in the direction 'HH' to show more clearly how the two electrical connectors are electrically mated.

FIG. 8*b* illustrates a cross-sectional enlarged side view of the electrical connector assembly 600 without showing the housings 126, 226 of the electrical connectors 100, 200 in the direction "HH" of FIG. 7*b*. As shown in FIG. 8*b*, each terminal pair 102, 104 of the electrical connector 100 is configured to mate with a complementary terminal pair 204, 202 of the like electrical connector 200 to allow electrical signal transmission. It should be appreciated that when the second electrical connector 200 is inverted, the first terminal pair 202 comprising mating portions 210*a*, 210*b* of the second electrical connector 200 is arranged to mate with the second terminal pair 104 of the first electrical connector 100 having the mating portions 112*a*, 112*b*. Likewise, the second terminal pair 204 having mating portions 212*a*, 212*b* of the second electrical connector 200 is arranged to mate with the first terminal pair 102 having mating portions 110*a*, 110*b* of the first electrical connector 100. The mating is achieved via the mating portions 110*a*, 110*b*, 212*a*, 212*b*, 112*a*, 112*b*, 210*a*, 210*b*. Furthermore, as shown in FIG. 8*b*, the ground shields 122, 222 of the first and second electrical connectors 100, 200 are arranged to shield the terminals bodies of the mated terminal pairs 102, 104, 202, 204 almost completely when the electrical connectors 100, 200 are nested together.

As mentioned earlier, the terminals 102*a*, 102*b* of the first terminal pair 102 of the electrical connector 100 have different first and second electrical lengths whereas the terminals 104*a*, 104*b* of the second terminal pair 104 of the electrical connector 100 have different third and fourth electrical lengths. Similarly, terminals 202*a*, 202*b* of a first terminal pair 202 of the electrical connector 200 respectively have the first and second electrical lengths whereas terminals 204*a*, 204*b* of a second terminal pair 204 of the electrical connector 200 respectively have the third and fourth electrical lengths. A sum of the first and third electrical lengths is substantially the same as a sum of the second and fourth electrical lengths. The term "substantially the same" here is used to mean that a difference in the sum of the first and third electrical lengths, and the sum of the second and fourth electrical lengths is less than 5%. Therefore, the mated terminals 202*a* and 104*a*, 102*a* and 204*a*, 202*b* and 104*b*, 102*b* and 204*b* of the electrical connector assembly 600 have substantially same electrical lengths. More specifically, this means that a combined electrical length of the mated terminals 202*a* and 104*a* (or 102*a* and 204*a*) respectively having the first and third electrical lengths is substantially the same as a combined electrical length of the mated terminals 202*b* and 104*b* (or 102*b* and 204*b*) respectively having the second and fourth electrical lengths. Again, "substantially same" here is used to mean that a difference in the electrical lengths of the mated terminals 202*a* and 104*a*, 102*a* and 204*a*, 202*b* and 104*b*, 102*b* and 204*b* is less than 5%.

It should also be appreciated that the terminals 102*a*, 102*b*, 104*a*, 104*b* of each terminal pair 102, 104 of the electrical connector 100 have different longitudinal profiles and the terminals 202*a*, 202*b*, 204*a*, 204*b* of each terminal pair 202, 204 of the like electrical connector 200 have different longitudinal profiles. However, the combined longitudinal profiles of the mated terminals 202*a* and 104*a*, 102*a* and 204*a*, 202*b* and 104*b*, 102*b* and 204*b* of the electrical connector assembly 600 are configured to create the substantially same electrical lengths of the mated terminals 202*a* and 104*a*, 102*a* and 204*a*, 202*b* and 104*b*, 102*b* and 204*b*. This is particularly advantageous since the different longitudinal profiles (or electrical lengths) enable more flexibility in arranging the terminal pairs 102, 104 in order to reduce the size of the electrical connector 100 and yet when the electrical connector 100 is stacked with another electrical connector 200, the combined profiles create substantially same electrical lengths, which is particularly useful if the electrical connectors 100, 200 are configured to carry differential signals. Furthermore, the resilience of the mating portions 112*a*, 112*b*, 212*a*, 212*b* of the terminals 104*a*, 104*b*, 204*a*, 204*b* allow compressive contact between the mated terminals 202*a* and 104*a*, 102*a* and 204*a*, 202*b* and 104*b*, 102*b* and 204*b*.

Figure 5A:
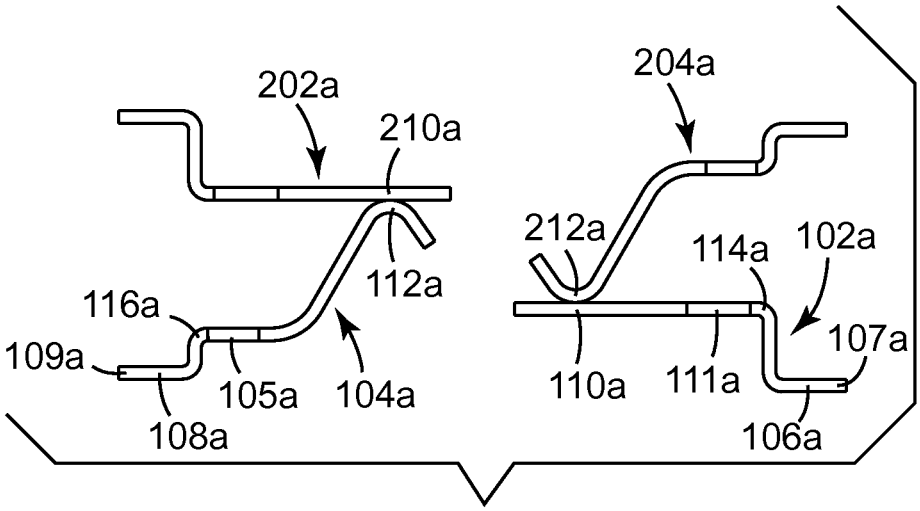
FIGS. 5*a* and 5*b* respectively illustrate mated terminals of an electrical connector assembly comprising the electrical connector of FIG. 1*a* and a second electrical connector identical to the electrical connector of FIG. 1*a*, with the mated terminals of FIG. 5*a* configured to carry positive signals of differential signals and the mated terminals of FIG. 5*b* configured to carry negative signals of the differential signals.
Figure 5B:
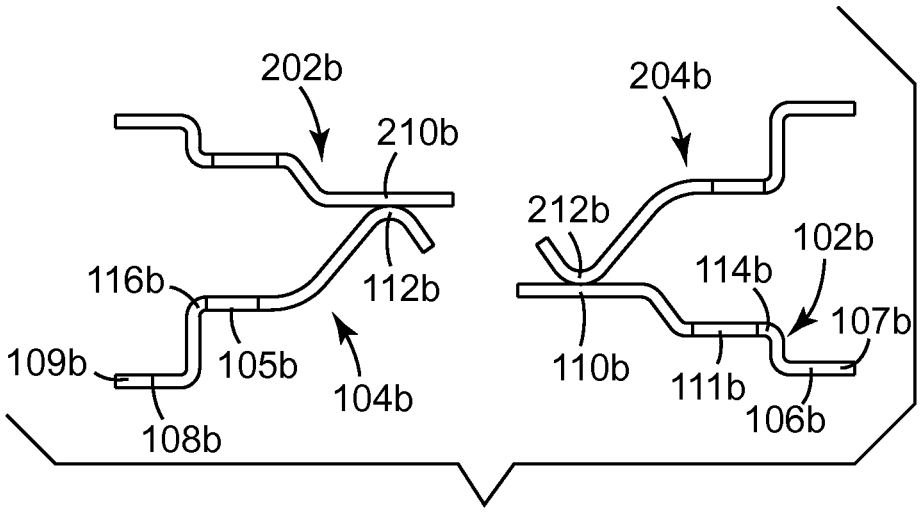

FIG. 5*a* illustrates the mated terminals 202*a* and 104*a*, and 102*a* and 204*a* of the electrical connector assembly 600 which are configured to carry positive signals of the differential signals whereas FIG. 5*b* illustrates the mated terminals 202*b* and 104*b*, and 102*b* and 204*b* of the electrical connector assembly 600 which are configured to carry negative signals of the differential signals. As mentioned above, a combined electrical length of the mated terminals 202*a* and 104*a* (or 102*a* and 204*a*) is substantially the same as a combined electrical length of the mated terminals 202*b* and 104*b* (or 102*b* and 204*b*). In other words, an electrical length the positive signals travel along is substantially the same as an electrical length the negative signals travel along.

When the electrical connector 100 and the like electrical connector 200 are separate (i.e. not mated with each other), it has been found that each terminal pair 102, 104 of the electrical connector 100 has an impedance mismatch of at least 10%. In other words, the impedance mismatch between the terminals 102*a*, 102*b* of the first terminal pair 102 and the impedance mismatch between the terminals 104*a*, 104*b* of the second terminal pair 104 are both at least 10%. The same applies for each terminal pair 202, 204 of the like electrical connector 200. The impedance mismatch may be reduced via mating of the electrical connector 100 and the like electrical connector 200. More specifically, the mating of the electrical connector 100 and the like electrical connector 200 results in a plurality of mated terminal pairs 102*a* and 204*a*, 102*b* and 204*b*, 104*a* and 202*a*, and 104*b* and 202*b* whereby each mated terminal pair 102*a* and 204*a*, 102*b* and 204*b*, 104*a* and 202*a*, and 104*b* and 202*b* has an impedance mismatch of less than about 5%. This means that the impedance mismatch between the mated terminals 104*a* and 202*a*, and the mated terminals 104*b* and 202*b* is less than about 5%. Similarly, the impedance mismatch between the mated terminals 102*a* and 204*a*, and the mated terminals 102*b* and 204*b* is less than about 5%. This improvement in impedance mismatch is due to the following reason.

The impedances are measured using a Time Domain Reflectometer (TDR) (which is a frequently used tool for measuring impedances). When the electrical connector 100 is not mated with the like electrical connector 200, only one end (in particular, the terminating portion 106*a*, 106*b*, 108*a*, 108*b*) of each of its terminals 102*a*, 102*b*, 104*a*, 104*b* is soldered to a circuit board, whereas the other end is a free-end which is not electrically terminated. The same applies for the like electrical connector 200. However, when the electrical connectors 100, 200 are mated with each other, both ends of each terminal 102*a*, 102*b*, 104*a*, 104*b*, 202*a*, 202*b*, 204*a*, 204*b* are electrically terminated since the free ends of the terminals 102*a*, 102*b*, 104*a*, 104*b* of the electrical connector 100 are mated with the free ends of the terminals 204*a*, 204*b*, 202*a*, 202*b* of the like electrical connector 200 whereas the other ends of the terminals 102*a*, 102*b*, 104*a*, 104*b*, 202*a*, 202*b*, 204*a*, 204*b* are soldered to the respective circuit boards. In this way, it has been found that the impedance mismatch between the mated terminals 102*a* and 204*a*, 102*b* and 204*b*, 104*a* and 202*a*, and 104*b* and 202*b* is lower than the impedance mismatch between the terminals 102*a*, 102*b*, 104*a*, 104*b*, 202*a*, 202*b*, 204*a*, 204*b* of each terminal pair 102, 104, 202, 204, which is unpredictable.

It should be appreciated that the described embodiment is particularly advantageous. With the described embodiment, it is possible to manufacture the electrical connector 100 with a pitch of less than or equal to 0.5 mm and a stack height 101 (as shown in FIG. 1*a*) of less than or equal to 4 mm. In fact, the electrical connector 100 is able to be manufactured with a stack height 101 of less than or equal to 1 mm. Such a low stack height allows the lengths (and thus very often, electrical lengths) of the terminals 102*a*, 102*b*, 104*a*, 104*b* to be reduced, increasing the speed of transmission of signals. Also, when the electrical connector 100 is mated with a like electrical connector, the maximum stack height of the mated pair is at most 2 mm. The electrical connector 100 is also able to be manufactured with a dimension of at most 18 mm by 5.4 mm. Currently, many drives manufactured by several solid state drive makers have significant space constraints. With the above-mentioned reduced dimensions, the electrical connector 100 is able to overcome such space constraints.

The above-mentioned dimensions of the electrical connector 100 are achievable because the electrical connector 100 comprises terminals 102*a*, 102*b*, 104*a*, 104*b* of different longitudinal profiles and different lengths in each terminal pair 102, 104. This provides flexibility in arranging the terminals 102*a*, 102*b*, 104*a*, 104*b* and thus, enables optimization of space in the electrical connector 100. For example, it allows the use of overlapping retention channels 118*a*, 118*b*, 120*a*, 120*b* for housing the respective terminals 102*a*, 102*b*, 104*a*, 104*b*. Therefore, the different longitudinal profiles and different lengths of the terminals 102*a*, 102*b*, 104*a*, 104*b* helps to reduce the profile and pitch of the electrical connector 100.

However, the different longitudinal profiles and different lengths of the terminals 102*a*, 102*b*, 104*a*, 104*b* often lead to different electrical lengths between the terminals 102*a*, 102*b*, 104*a*, 104*b* in each terminal pair 102, 104. This in turn leads to timing offsets in the differential signals carried by the terminals 102*a*, 102*b*, 104*a*, 104*b* and thus, such a feature is generally not encouraged. Nevertheless, the electrical connector 100 is configured to mate with a like electrical connector such that the mated terminals have the same electrical lengths. This thus overcomes the problem of the timing offsets in the differential signals.

Furthermore, each terminal 102*a*, 102*b*, 104*a*, 104*b* of the electrical connector 100 comprises a step portion 114*a*, 114*b*, 116*a*, 116*b*. This step portion 114*a*, 114*b*, 116*a*, 116*b* is useful as its height can be varied to achieve the difference in the longitudinal profiles, lengths and electrical lengths of the terminals 102*a*, 102*b*, 104*a*, 104*b* of each terminal pair 102, 104.

In addition, due to the reduction in space required by the terminals 102*a*, 102*b*, 104*a*, 104*b* of each terminal pair 102, 104, ground shields 122 interleaving adjacent terminal pairs 102, 104 may be included in the electrical connector 100. These ground shields 122 help to reduce the amount of cross-talk, in other words, provide a high cross-talk performance (both near end and far end). Thus, the adjacent terminal pairs 102, 104 may be arranged nearer to each other, hence further reducing the pitch of the electrical connector 100. Furthermore, the reduction in both near end and far end cross-talk by the ground shields 122 also eliminates the need for row shields i.e. shields interleaving the two parallel rows 124*a*, 124*b* of terminal pairs 102, 104 in the electrical connector 100. With the reduction in cross-talk, the electrical connector 100 is therefore able to achieve superior performance for signals in the GHz frequency range and is able to work as a high-speed electrical connector in the Giga bits range. This allows it to be used in many drives manufactured by several solid state drive makers which are configured to work at high speeds (for example, at a data rate of 6 Gbps).

Furthermore, the electrical connector 100 uses an edge-coupled design whereby the terminals 102*a*, 102*b*, 104*a*, 104*b* of each terminal pair 102, 104 are edge-coupled. This edge-coupled design increases the surface areas of the contacting surfaces between the terminals 102*a*, 102*b*, 104*a*, 104*b* of the electrical connector 100 and complementary terminals of a like electrical connector when the electrical connectors are mated together.

Furthermore, because the electrical connector 100 is hermaphroditic and stackable with a like electrical connector to form an electrical connector assembly in a stack configuration, a plurality of electrical connectors identical to the electrical connector 100 but having different heights (for example, in steps of 0.5 mm) may be mass manufactured for use in electrical connector assemblies having different technical requirements. More specifically, a height of the stack configuration formed by the like hermaphroditic electrical connectors may be adapted or chosen to match the technical requirements of the electrical connector assembly by mixing and matching electrical connectors of different heights. For example, electrical connector assemblies requiring maximum heights of 2 mm, 2.5 mm and 3 mm may be respectively formed by mating two electrical connectors of stack height 1 mm, an electrical connector of stack height 1 mm with an electrical connector of stack height 1.5 mm, and two electrical connectors of stack height 1.5 mm. Electrical connectors of different heights may be manufactured while preserving most (for example, at least, 95%) of the connector design. This may be done by for example, changing the step height of the electrical connector 100. This allows mass production of the electrical connectors of different heights which can help to reduce manufacturing costs.

Figure 12:
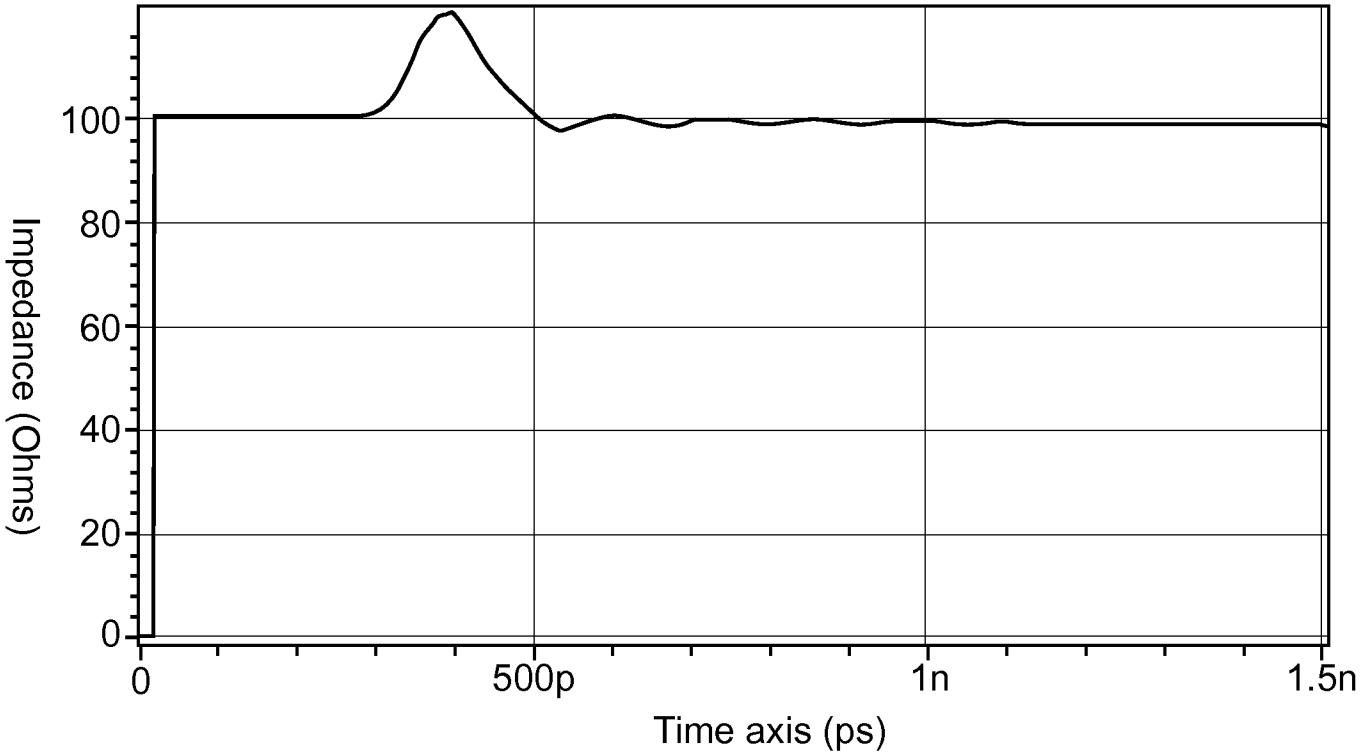
FIG. 12 illustrates a Time Domain Reflectometer plot of the electrical connector assembly of FIG. 6*c;*

FIGS. 12-15 illustrate results obtained through electrical modeling of the electrical connector assembly 600. In particular, FIG. 12 illustrates a Time Domain Reflectometer (TDR) plot of the electrical connector assembly 600. This plot is obtained using a TDR operating with a 100 ps (20%-80%) rise time. Through the TDR, the electrical connector is found to have a differential impedance of 100±15Ω.

Figure 13A:
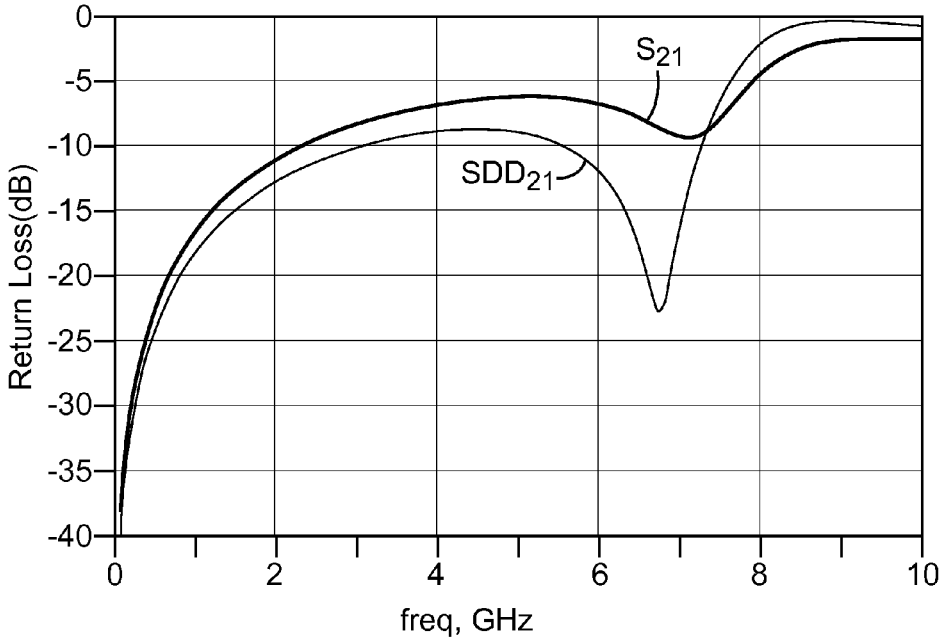
FIGS. 13*a* and 13*b* respectively illustrate plots showing single ended and differential return losses, and single ended and differential insertion losses (IL) of the electrical connector assembly of FIG. 6*c;*
Figure 13B:
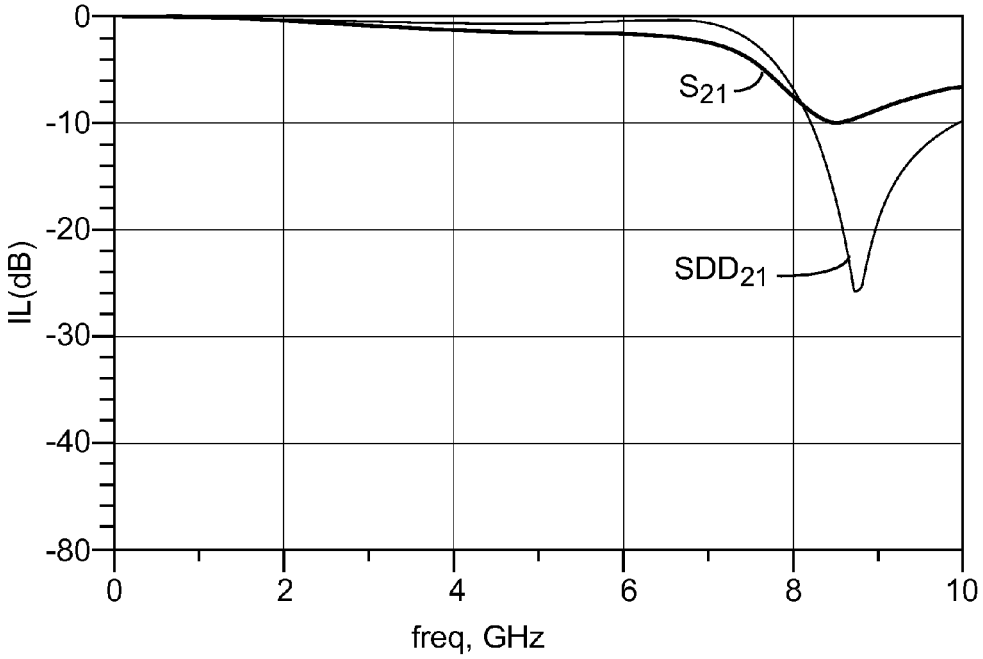

FIGS. 13*a* and 13*b* respectively illustrate plots showing return loss and insertion loss (IL) of the electrical connector assembly 600 against frequencies of the signals carried by the electrical connector assembly 600. As shown in FIG. 13*a*, the single ended return loss ($S_{21}$) of the electrical connector assembly 600 is −12 dB at about 6 GHz whereas the differential return loss ($SDD_{21}$) is −6 dB at about 6 GHz. As shown in FIG. 13*b*, the single ended insertion loss (S21) of the electrical connector assembly 600 is −2 dB at about 6 GHz whereas the differential insertion loss ($SDD_{21}$) of the electrical connector assembly 600 is −0.6 dB at about 6 GHz.

Figure 14A:
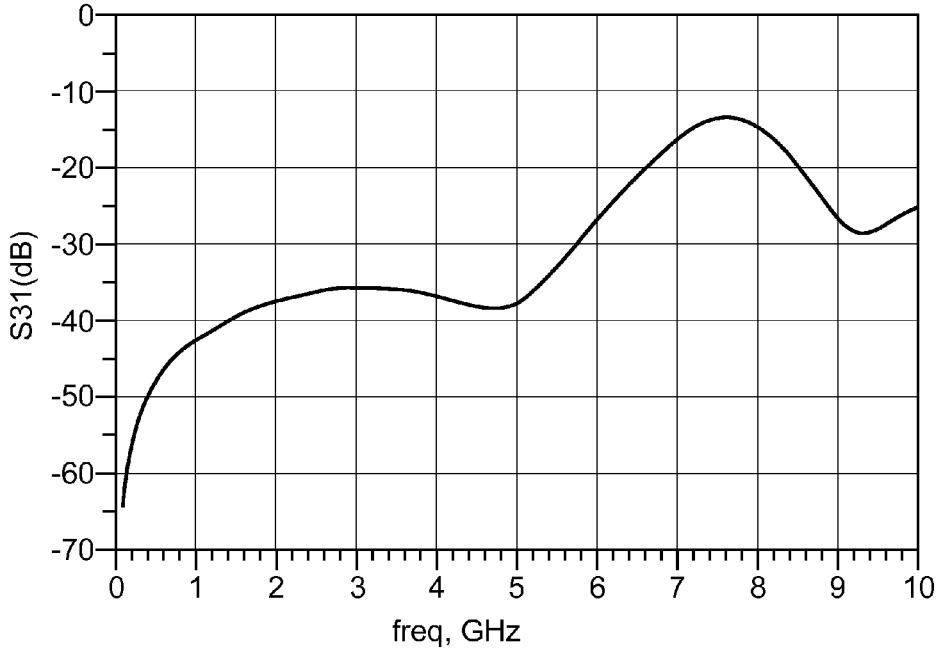
FIGS. 14*a* and 14*b* respectively illustrate plots showing differential near end and differential far end cross talk of the electrical connector assembly of FIG. 6*c*.
Figure 14B:
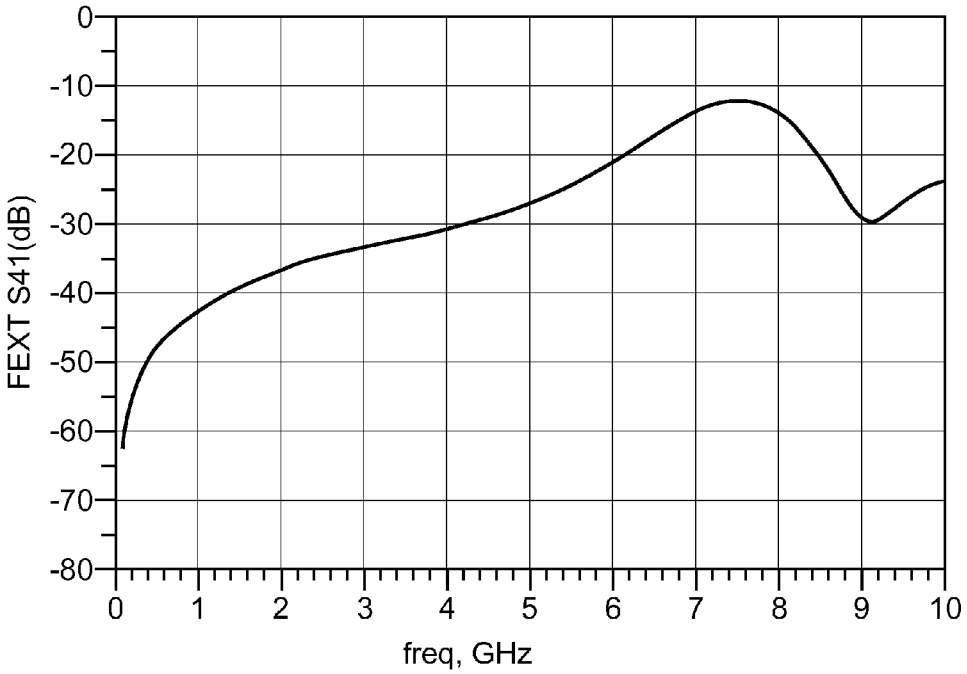
Figure 15:
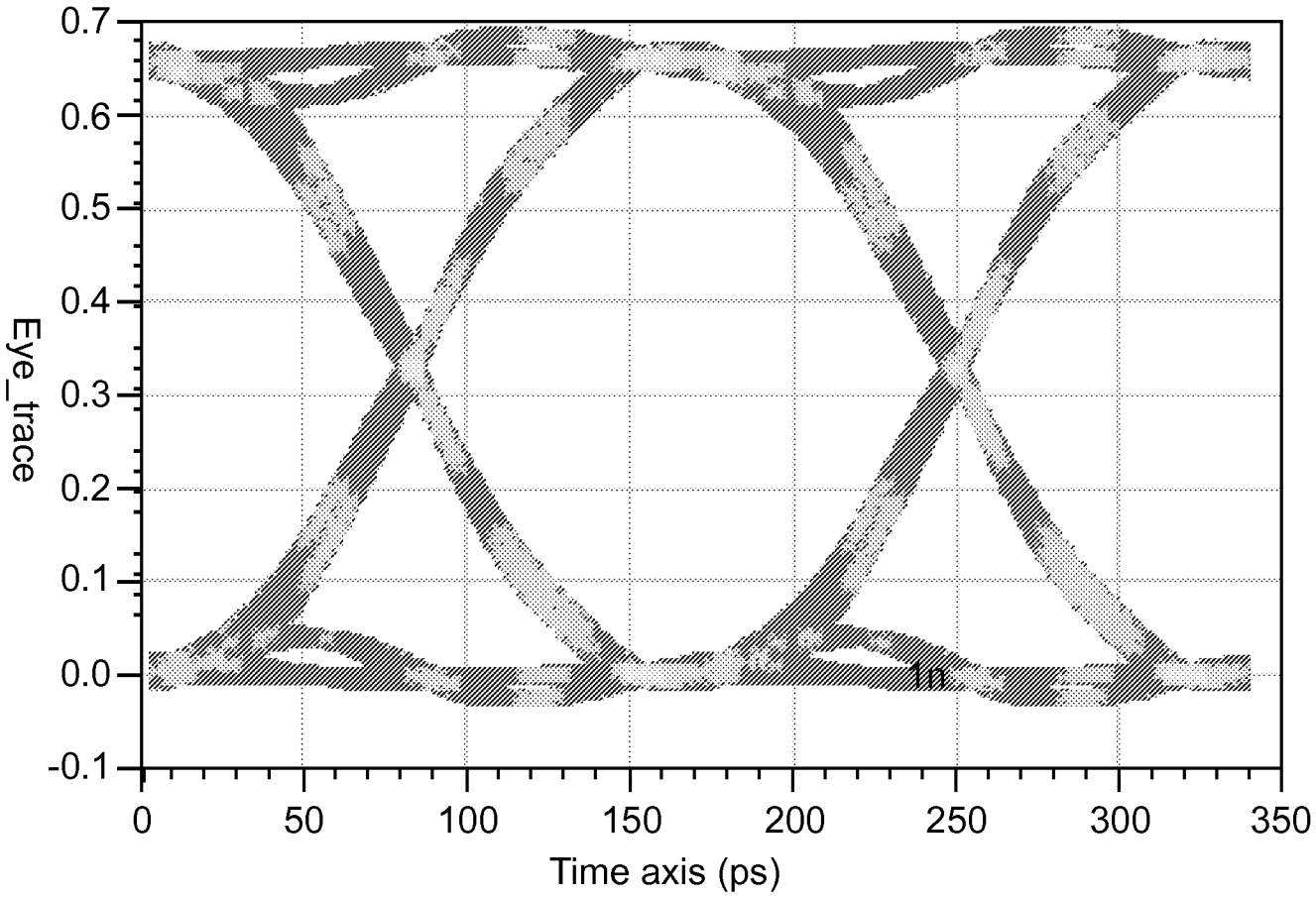
FIG. 15 illustrates an eye pattern of the electrical connector assembly of FIG. 6*c;*

FIGS. 14*a* and 14*b* respectively illustrate plots showing differential near end and differential far end cross talk of the electrical connector 100 against frequencies of the signals carried by the electrical connector 100. As shown in FIGS. 14*a* and 14*b*, the electrical connector 100 has a good cross-talk performance. From FIG. 14*a*, it can be seen that the differential near end cross talk of the electrical connector assembly 600 is less than −25 dB up to about 6 GHz whereas the differential far end cross talk of the electrical connector assembly 600 is less than −20 dB up to about 6 GHz. FIG.

15 illustrates an eye pattern of the electrical connector assembly 600 when it is configured to carry signals at 6 Gigabits/second.

Figure 9A:
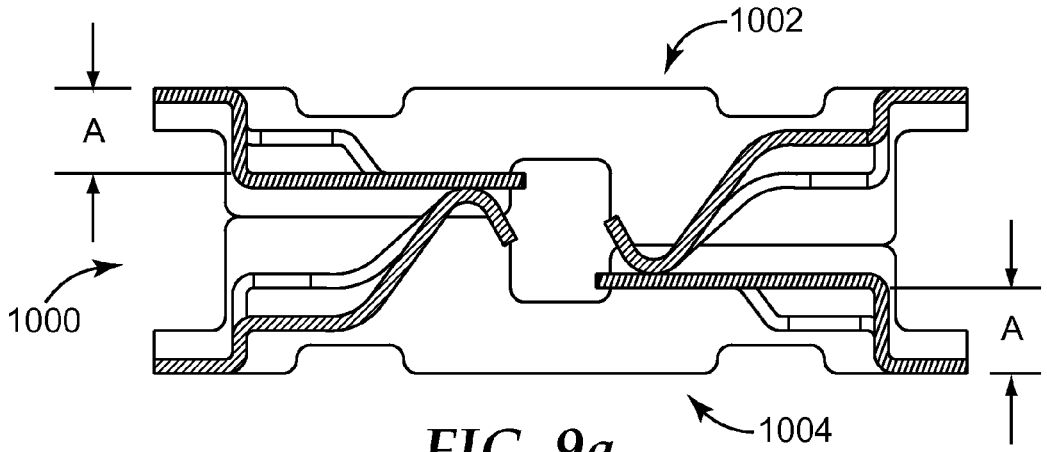
FIGS. 9*a*-9*c* illustrate different electrical connector assemblies comprising like electrical connectors of the electrical connector of FIG. 1*a;*
Figure 9B:
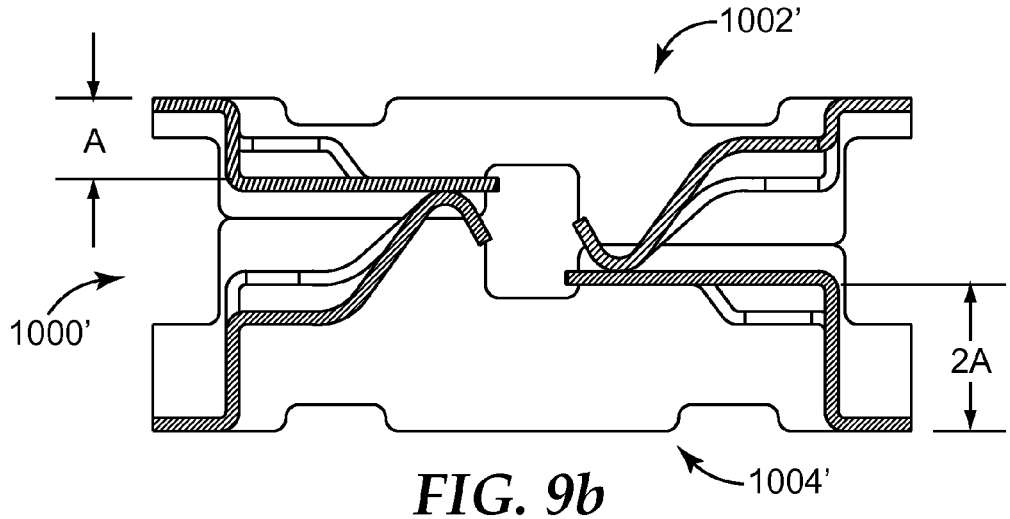
Figure 9C:
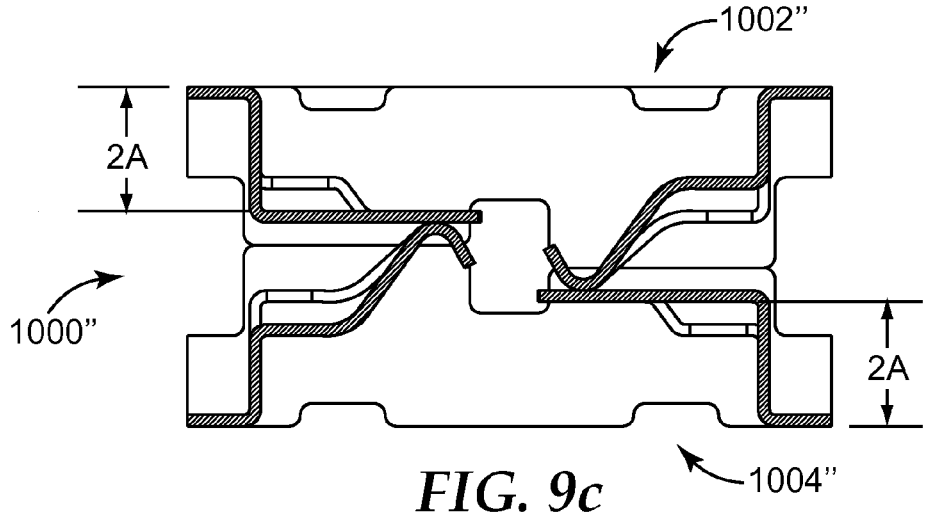

The described embodiment should not be construed as limitative. For example, the step portions 114*a*, 114*b* of the first terminal pair 102 and the step portions 116*a*, 116*b* of the second terminal pair 104 as shown more clearly in FIG. 8*a* may take different forms, and the electrical connectors to be stacked together may also have different heights. These examples are illustrated in FIGS. 9*a*-9*c* using different electrical connector assemblies 1000, 1000', 1000" respectively comprising like hermaphroditic electrical connectors 1002, 1004, like hermaphroditic electrical connectors 1002', 1004' and like hermaphroditic electrical connectors 1002", 1004". As shown in FIGS. 9*a*-9*c*, the like electrical connectors 1002, 1004 (or 1002', 1004' or 1002", 1004") of each electrical connector assembly 1000 (or 1000' or 1000") are arranged to be stacked together in a stack configuration. The electrical connectors 1002, 1004, 1002', 1004', 1002" and 1004" are like electrical connectors with respect to the electrical connector 100. Furthermore, each electrical connector 1002, 1004, 1002', 1004', 1002", 1004" has a first set of terminals for coupling to a respective circuit board (not shown in FIGS. 9*a*-9*c*) and a second set of terminals for mating contact with the other electrical connector 1004, 1002, 1004', 1002', 1004", 1002" in the stack configuration. This enables signals to be transmitted between the respective circuit boards (not shown in FIGS. 9*a*-9*c*).

Further, as shown in FIGS. 9*a*-9*c*, the electrical connectors 1002, 1004, 1002', 1004', 1002", 1004" have different step heights. In particular, each of the electrical connectors 1002, 1002', 1004 has a step height "A" whereas each of the electrical connectors 1004, 1004', 1002", 1004" has a step height 2A. In other words, while the electrical connector assemblies 1000 and 1000" comprise electrical connectors 1002, 1004 and 1002", 1004" of the same step heights, the electrical connector assembly 1000' comprises electrical connectors 1002', 1004' of different step heights. Since the electrical connector assemblies 1000, 1000', 1000" comprise different electrical connectors 1002, 1004, 1002', 1004', 1002" and 1004" having different step heights, the maximum stack heights of the electrical connector assemblies 1000, 1000', 1000" are different. Therefore, the electrical connector assemblies 1000, 1000', 1000" may be used to accommodate different predetermined separation distances between respective circuit boards.

With a plurality of like electrical connectors of different step heights (and hence, different stack heights and maximum heights) such as the electrical connectors 1002, 1004, 1002', 1004', 1002" and 1004" shown in FIGS. 9*a*-9*c*, a pair of circuit boards can be coupled together to enable signal transmission therebetween with the coupling having a predetermined separation distance between the circuit boards. A method of performing this coupling according to a preferred embodiment of the present invention is to first select a pair of electrical connectors from the plurality of like connectors of different step heights such that the selected pair of electrical connectors when coupled to the respective circuit boards and mated with each other has a combined height which matches the required separation distance between the respective circuit boards. A first set of terminals of the selected pair of electrical connectors is then coupled to the respective circuit boards whereas a second set of terminals of the selected pair of electrical connectors is mated together in a stack configuration to match the required separation distance between the respective circuit boards.

Figure 1C:
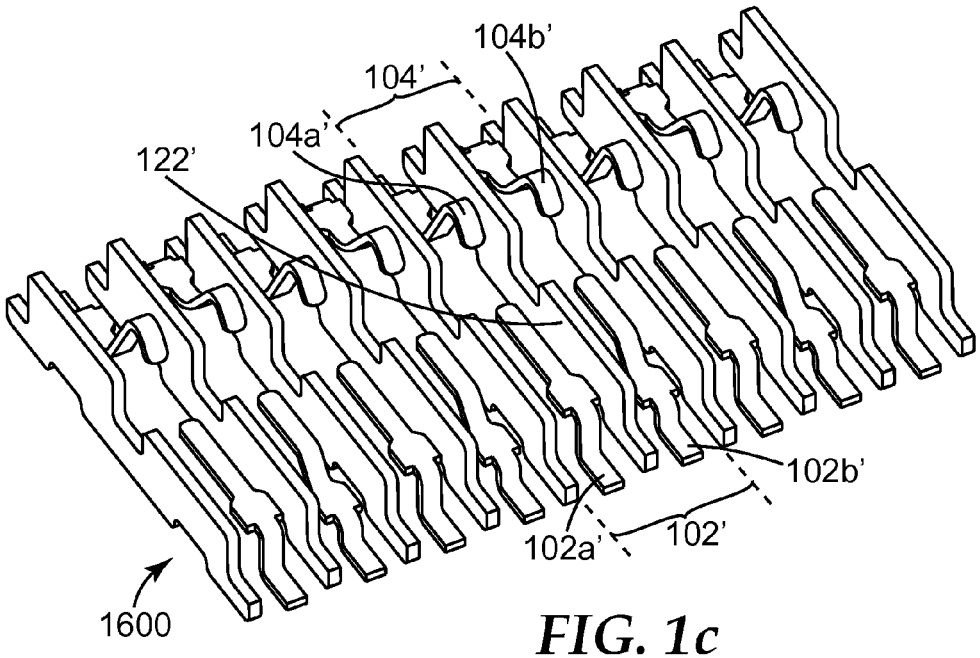
FIG. 1*c* illustrates an electrical connector which is a first variation of the electrical connector of FIG. 1*a* without showing a housing of the electrical connector.

The described embodiment uses terminal pairs 102, 104 as an example which are configured to carry differential signals, but this may not be so. For example, FIG. 1*c* illustrates an electrical connector 1600 which is a variation of the electrical connector 100. The electrical connector 1600 is similar to the electrical connector 100 and thus, the same parts will have the same reference numerals, with addition of prime. As shown in FIG. 1*c*, the electrical connector 1600 also comprises a plurality of terminal pairs 102', 104', with each terminal pair 102', 104' comprising terminals 102*a*', 102*b*', 104*a*', 104*b*' of different longitudinal profiles. The electrical connector 1600 also comprises a plurality of ground shields 122'. However, each ground shield 122' of the electrical connector 1600 interleaves adjacent terminals 102*a*', 102*b*', 104*a*', 104*b*' instead of adjacent terminal pairs 102', 104' (as in the electrical connector 100). Note that the electrical connector 1600 also comprises a housing (not shown in FIG. 1*c*) similar to the housing 126 of electrical connector 100.

Further variations are also possible within the scope of the invention as will be clear to a skilled reader. For example, the terminals 102*a*, 102*b*, 104*a*, 104*b* of each terminal pair 102, 104 of the electrical connector 100 need not be of different longitudinal profiles and different lengths. They may be of different longitudinal profiles but have same lengths, or different lengths but have same longitudinal profiles. Also, terminals having different longitudinal profiles may have same electrical lengths (for example, if they are made of different materials). Similarly, terminals having same longitudinal profiles may have different electrical lengths (for example, if they are made of different materials).

Furthermore, the longitudinal profiles, lengths and electrical lengths of the terminals 102*a*, 102*b* of the first terminal pair 102 need not be different from that of the terminals 104*a*, 104*b* of the second terminal pair 104. One or both of the terminals 102*a*, 102*b* of the first terminal pair 102 may have the same longitudinal profiles, lengths and/or electrical lengths as one or both of the terminals 104*a*, 104*b* of the second terminal pair 104.

In addition, each terminal pair 102, 104 of the electrical connector 100 may comprise terminals 102*a*, 102*b*, 104*a*, 104*b* of different longitudinal profiles which are not arranged beside each other (i.e. they are spaced apart from each other with at least one other terminal in between them). In other words, the electrical connector 100 may simply comprise a first set of terminals and a second set of terminals having different longitudinal profiles as the first set of terminals wherein each terminal is configured to mate with a complementary terminal of a like electrical connector to allow electrical signal transmission.

Also, each terminal pair 102, 104 of the electrical connector 100 may be configured to carry singled ended signals instead of differential signals. In other words, the electrical connector 100 may be driven single-endedly and necessary corrections to for example skew or propagation delays may be corrected elsewhere in the circuit (for example, on the circuit board).

Furthermore, the ground shields 122 of the electrical connector 100 may wholly (instead of only partially as illustrated in FIG. 8*a*) shield the terminal bodies of the terminals 102*a*, 102*b*, 104*a*, 104*b*. The terminal pairs 102, 104 of the electrical connector 100 may also be arranged along a plurality of rows comprising more than two rows and the plurality of rows need not be parallel to each other. Also, the terminals 102*a*, 102*b*, 104*a*, 104*b* need not be partially housed in the respective retention channels 118*a*, 118*b*, 120*a*, 120*b*. Instead, they may be completely housed in the retention channels 118*a*, 118*b*, 120*a*, 120*b*. Similarly, the ground shields 122 need not be partially housed in the respective retention members 117. Instead, they may be completely housed in the retention members 117. The terminals 102*a*, 102*b*, 104*a*, 104*b* may also be coupled to the retention channels 118*a*, 118*b*, 120*a*, 120*b* in a manner different from that described above with reference to the preferred embodiment. For example, the first and second gaps 119*a*, 119*b*, 125*a*, 125*b*, 121*a*, 121*b*, 127*a*, 127*b* may take different shapes or the terminals 102*a*, 102*b*, 104*a*, 104*b* may be soldered to (and not slotted into the first and second gaps 119*a*, 119*b*, 125*a*, 125*b*, 121*a*, 121*b*, 127*a*, 127*b* of) the retention channels 118*a*, 118*b*, 120*a*, 120*b*. Also, the terminating portions 106*a*, 106*b*, 108*a*, 108*b* need not be soldered to the circuit board and may be connected to the circuit board in other ways.

Also, the electrical connectors 100, 200 of the electrical connector assembly 600 need not be identical. Instead, they may simply be like electrical connectors having like functional portions performing the same function. Specifically in the described embodiments, the functional portions relate to the terminals of the electrical connectors 100, 200. In other words, the housings 126, 226 of the electrical connectors 100, 200 may be different.

Figure 11A:
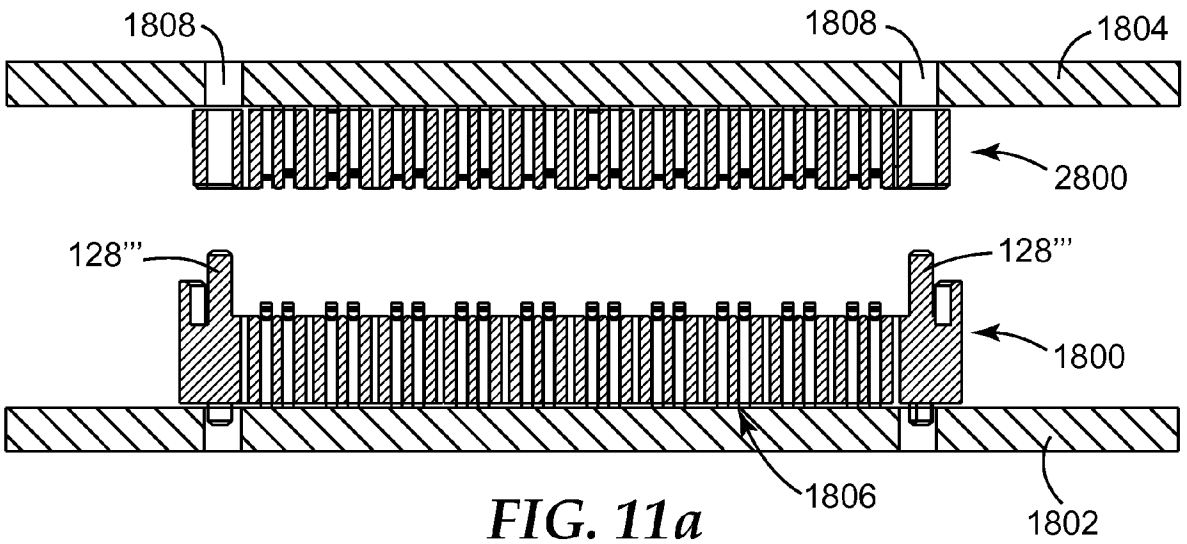
FIG. 11*a* illustrates side views of electrical connectors which are variations of the electrical connectors of FIG. 10*a*.
Figure 11B:
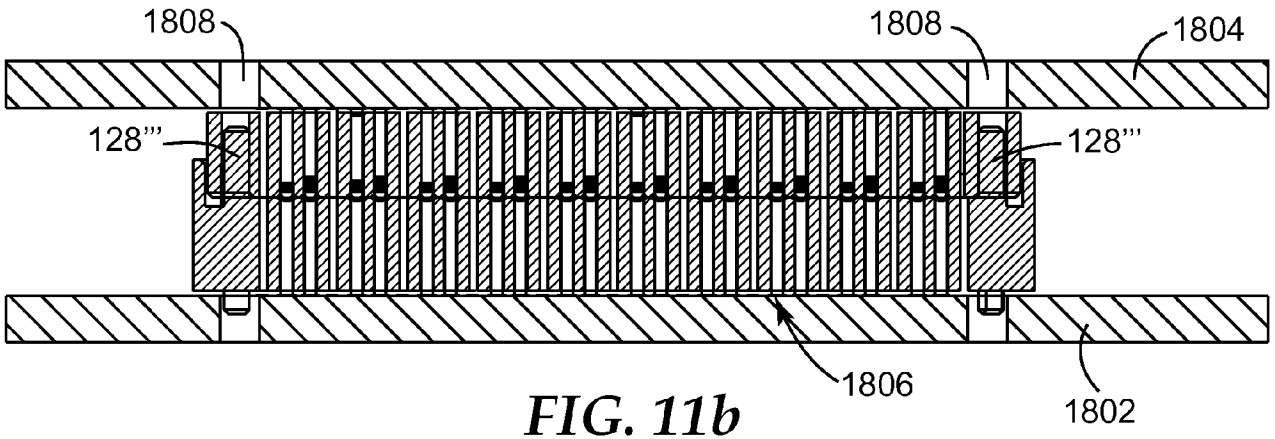
FIG. 11*b* illustrates a side view of an electrical connector assembly which is a variation of the electrical connector assembly of FIG. 10*b*.

In addition, as mentioned above, the height of the electrical connector 100 may be varied. For example, FIG. 11*a* illustrates side views of the electrical connectors 1800, 2800 which are variations of the electrical connectors 100, 200 whereby these electrical connectors 1800, 2800 have maximum heights '2B' instead of 'B'. The electrical connectors 1800, 2800 are also coupled to respective circuit boards 1802, 1804. The electrical connectors 1800, 2800 are similar to the electrical connectors 100, 200 and thus, the same parts will have the same reference numerals with the addition of triple prime. FIG. 11*b* illustrates a side view of the electrical connector assembly 1806 which is a variation of the electrical connector assembly 600 whereby this variation is formed using the electrical connectors 1800, 2800 shown in FIG. 11*a*. A maximum stack height of the electrical connector assembly 1806 is also less than a sum of the maximum heights of the electrical connectors 1800, 2800 forming the electrical connector assembly 1806. However, unlike the posts 128 of the electrical connector 100, the posts 128''' of the electrical connector 1800 do not extend through the holes 1808 of the circuit board 1804. This is because the heights of the posts 128''' are approximately the same as the heights of the posts 128 while the heights of the electrical connectors 1800, 2800 are double the heights of the electrical connectors 100, 200. In other words, when varying the height of the electrical connector 100 in the embodiments, the heights of the posts 128 are kept relatively constant. Note that the posts of the electrical connector 2800 are not shown in FIGS. 11*a* and 11*b* to improve clarity of these figures.

Also, although the electrical connector 100 is a low profile electrical connector, it is configurable to become a high profile electrical connector.

Following are exemplary embodiments of an electrical connector according to aspects of the present invention.

Embodiment 1 is an electrical connector comprising first and second terminal pairs configured to electrically couple to a same device, each terminal pair comprising terminals, with the terminals in the first terminal pair having different first and second electrical lengths and the terminals in the second terminal pair having different third and fourth electrical lengths, wherein a sum of the first and third electrical lengths is substantially the same as a sum of the second and fourth electrical lengths.

Embodiment 2 is an electrical connector according to embodiment 1, wherein the terminals in at least one of the first and second terminal pairs have different longitudinal profiles.

Embodiment 3 is an electrical connector according to embodiment 1 or 2, wherein at least one terminal in the first pair of terminals has a different longitudinal profile than at least one terminal in the second pair of terminals.

Embodiment 4 is an electrical connector according to any of embodiments 1-3, wherein terminating ends of the terminals in the first pair of terminals face away from terminating ends of the terminals in the second pair of terminals.

Embodiment 5 is an electrical connector according to any of the preceding embodiments, wherein a difference between the sum of the first and third electrical lengths and the sum of the second and fourth electrical lengths is less than 5%.

Embodiment 6 is an electrical connector according to any of the preceding embodiments, wherein each terminal pair has an impedance mismatch of at least 10% and is configured to mate with a complementary terminal pair of a like electrical connector, the mating of the two connectors resulting in a plurality of mated terminal pairs, each mated terminal pair having a mated impedance mismatch of less than about 5%.

Embodiment 7 is an electrical connector according to embodiment 6, wherein the impedance mismatch of each terminal pair is at least 15%.

Embodiment 8 is an electrical connector according to embodiment 6 or 7, wherein the mated impedance mismatch is less than about 3%.

Embodiment 9 is an electrical connector comprising a plurality of terminal pairs, each terminal pair comprising terminals and having an impedance mismatch of at least 10% and being configured to mate with a complementary terminal pair of a like electrical connector, the mating of the two connectors resulting in a plurality of mated terminal pairs, each mated terminal pair having a mated impedance mismatch of less than about 5%.

Embodiment 10 is an electrical connector according to embodiment 9, wherein the impedance mismatch of each terminal pair is at least 15%.

Embodiment 11 is an electrical connector according to embodiment 9 or 10, wherein the mated impedance mismatch is less than about 3%.

Embodiment 12 is an electrical connector comprising: a plurality of terminal pairs, each terminal pair comprising terminals of different longitudinal profiles; wherein each terminal pair is configured to mate with a complementary terminal pair of a like electrical connector to allow electrical signal transmission.

Embodiment 13 is an electrical connector according to any of the preceding embodiments, wherein each terminal pair is configured to carry differential signals.

Embodiment 14 is an electrical connector according to any of the preceding embodiments, wherein the terminals of each terminal pair have different lengths.

Embodiment 15 is an electrical connector according to embodiment 14, wherein difference in the lengths of the terminals of each terminal pair ranges from 0.05 mm to 0.2 mm.

Embodiment 16 is an electrical connector according to any of embodiments 6-15, wherein each of the terminals of each terminal pair includes a terminal body having a terminating portion for connecting to a circuit board, a mating portion for mating to the complementary terminal pair of the like connector, and a step portion joining the terminating portion to the mating portion.

Embodiment 17 is an electrical connector according to embodiment 16, wherein the step portions of the terminals of said terminal pair have different heights to create the different longitudinal profiles.

Embodiment 18 is an electrical connector according to embodiment 16 or 17, wherein the mating portion has an arcuate shape.

Embodiment 19 is an electrical connector according to embodiment 16 or 17, wherein the mating portion is elongate.

Embodiment 20 is an electrical connector according to any of the preceding embodiments, wherein the terminals of each terminal pair are at least partially housed in respective retention channels of the connector, the respective retention channels being arranged to overlap at least partially with each other.

Embodiment 21 is an electrical connector according to any of the preceding embodiments, wherein the terminals of each terminal pair are edge-coupled.

Embodiment 22 is an electrical connector according to any of the preceding embodiments, further comprising a plurality of ground shields, each ground shield interleaving adjacent terminal pairs.

Embodiment 23 is an electrical connector according to embodiment 22 when dependent on any of embodiments 16-19, wherein each ground shield is arranged to at least partially shield the terminal bodies of the adjacent terminal pairs the ground shield interleaves.

Embodiment 24 is an electrical connector according to any of the preceding embodiments, wherein the terminal pairs are arranged along a plurality of rows.

Embodiment 25 is an electrical connector according to embodiment 24, wherein the plurality of rows comprises two parallel rows.

Embodiment 26 is an electrical connector according to any of the preceding embodiments, wherein a stack height of the electrical connector is less than 4 mm.

Embodiment 27 is an electrical connector according to embodiment 26, wherein the stack height of the electrical connector is less than 1 mm.

Embodiment 28 is an electrical connector according to any of the preceding embodiments, wherein the electrical connector is a board-to-board connector.

Embodiment 29 is an electrical connector assembly comprising: first and second electrical connectors for coupling to respective circuit boards, each electrical connector comprising a plurality of terminal pairs, each terminal pair comprising terminals of different electrical lengths; wherein the first electrical connector is stackable with the second electrical connector to enable the terminals of the first electrical connector to mate with corresponding terminals of the second electrical connector; and wherein the mated terminals have substantially same electrical lengths.

Embodiment 30 is an electrical connector assembly according to embodiment 29, wherein each terminal pair of the first and second electrical connectors is configured to carry differential signals.

Embodiment 31 is an electrical connector assembly according to embodiment 29 or 30, wherein the terminals of each terminal pair of each electrical connector have different longitudinal profiles, and wherein the combined longitudinal profiles of the mated terminals are configured to create the substantially same electrical lengths.

Embodiment 32 is an electrical connector assembly comprising: first and second electrical connectors for coupling to respective circuit boards, the first electrical connector having a first maximum height and the second electrical connector having a second maximum height; wherein the first and second electrical connectors are like connectors, and wherein the first electrical connector is stackable with the second electrical connector to form the electrical connector assembly, the electrical connector assembly having a maximum stack height less than a sum of the first and second maximum heights.

Embodiment 33 is an electrical connector comprising: a plurality of terminal pairs, each terminal pair comprising terminals of different longitudinal profiles; a plurality of ground shields, each ground shield interleaving adjacent terminals; wherein each terminal pair is configured to mate with a complementary terminal pair of a like electrical connector to allow electrical signal transmission; and wherein each of the plurality of terminals comprises a terminal body having a terminating portion for connecting to a circuit board, a mating portion for mating to the complementary terminal of the like electrical connector, and a step portion joining the terminating portion to the mating portion.

Embodiment 34 is an electrical connector according to embodiment 33, wherein the plurality of terminal pairs are arranged along a plurality of rows.

Embodiment 35 is an electrical connector according to embodiment 34, wherein the plurality of rows comprises two parallel rows.

Embodiment 36 is an electrical connector according to any of embodiments 33-35, wherein a stack height of the electrical connector is less than 4 mm.

Embodiment 37 is an electrical connector according to embodiment 36, wherein the stack height of the electrical connector is less than 1 mm.

Embodiment 38 is an electrical connector according to any of embodiments 33-37, wherein the electrical connector is a board-to-board connector.

Embodiment 39 is an electrical connector comprising: a first set of terminals and a second set of terminals having different longitudinal profiles as the first set of terminals; wherein each terminal is configured to mate with a complementary terminal of a like electrical connector to allow electrical signal transmission.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adoptions or variations of the preferred embodiments discussed herein. Therefore, it is manifestly intended that this invention be limited only by the claims and the equivalents thereof.

The invention claimed is:

1. An electrical connector comprising first and second terminal pairs configured to electrically couple to a same device, each terminal pair comprising terminals, with the terminals in the first terminal pair having different first and second electrical lengths and the terminals in the second terminal pair having different third and fourth electrical lengths, wherein a sum of the first and third electrical lengths is substantially the same as a sum of the second and fourth electrical lengths, wherein each terminal pair has an impedance mismatch of at least 10% and is configured to mate with a complementary terminal pair of a like electrical connector, the mating of the two connectors resulting in a plurality of mated terminal pairs, each mated terminal pair having a mated impedance mismatch of less than about 5%.

2. The electrical connector according to claim 1, wherein the terminals in at least one of the first and second terminal pairs have different longitudinal profiles.

3. The electrical connector according to claim 1, wherein at least one terminal in the first pair of terminals has a different longitudinal profile than at least one terminal in the second pair of terminals.

4. The electrical connector according to claim 1, wherein terminating ends of the terminals in the first pair of terminals face away from terminating ends of the terminals in the second pair of terminals.

5. The electrical connector according to claim 1, wherein a difference between the sum of the first and third electrical lengths and the sum of the second and fourth electrical lengths is less than 5%.

6. The electrical connector according to claim 1, wherein the impedance mismatch of each terminal pair is at least 15%.

7. The electrical connector according to claim 1, wherein the mated impedance mismatch is less than about 3%.

8. An electrical connector comprising a plurality of terminal pairs, each terminal pair comprising terminals and having an impedance mismatch of at least 10% and being configured to mate with a complementary terminal pair of a like electrical connector, the mating of the two connectors resulting in a plurality of mated terminal pairs, each mated terminal pair having a mated impedance mismatch of less than about 5%.

9. The electrical connector according to claim 8, wherein the impedance mismatch of each terminal pair is at least 15%.

10. The electrical connector according to claim 8, wherein the mated impedance mismatch is less than about 3%.

11. An electrical connector comprising:

a plurality of terminal pairs, the terminal pairs arranged in two rows in which the terminals of each terminal pair are offset from each other along a length direction of the rows, mating portions of the terminal pairs extending along a same direction that is substantially parallel to a width direction of the rows, each terminal pair having a first terminal having a first longitudinal profile and a second terminal having a second longitudinal profile different from the first longitudinal profile;

wherein each terminal pair is configured to mate with a complementary terminal pair of a like electrical connector to allow electrical signal transmission and the terminals of each terminal pair are at least partially housed in respective retention channels of the connector, the respective retention channels being arranged to overlap partially with each other.

12. The electrical connector according to claim 11, wherein each terminal pair is configured to carry differential signals.

13. The electrical connector according to claim 11, wherein the terminals of each terminal pair have different lengths.

14. The electrical connector according to claim 13, wherein difference in the lengths of the terminals of each terminal pair ranges from 0.05 mm to 0.2 mm.

15. The electrical connector according to any of claim 11, wherein each of the terminals of each terminal pair includes a terminal body having a terminating portion for connecting to a circuit board, a mating portion for mating to the complementary terminal pair of the like connector, and a step portion joining the terminating portion to the mating portion.

16. The electrical connector according to claim 15, wherein the step portions of the terminals of said terminal pair have different heights to create the different longitudinal profiles.

17. The electrical connector according to claim 15, wherein the mating portion has an arcuate shape.

18. The electrical connector according to claim 15, wherein the mating portion is elongate.

19. The electrical connector according to claim 11, wherein the terminals of each terminal pair are edge-coupled.

20. The electrical connector according to claim 11, further comprising a plurality of ground shields, each ground shield interleaving adjacent terminal pairs.

21. The electrical connector according to claim 20, wherein each ground shield is arranged to at least partially shield the terminal bodies of the adjacent terminal pairs the ground shield interleaves.

22. The electrical connector according to claim 11, wherein the terminal pairs are arranged along a plurality of rows.

23. The electrical connector according to claim 22, wherein the plurality of rows comprises two parallel rows.

24. The electrical connector according to claim 11, wherein a stack height of the electrical connector is less than 4 mm.

25. The electrical connector according to claim 24, wherein the stack height of the electrical connector is less than 1 mm.

26. The electrical connector according to claim 11, wherein the electrical connector is a board-to-board connector.

27. An electrical connector assembly comprising:

first and second electrical connectors for coupling to respective circuit boards, each electrical connector comprising a plurality of terminal pairs, each terminal pair comprising terminals of different electrical lengths, the terminal pairs arranged in two rows in which the terminals of each terminal pair are offset from each other along a length direction of the rows, mating portions of the terminal pairs extending along a same direction that is substantially parallel to a width direction of the rows;

wherein the first electrical connector is stackable with the second electrical connector to enable the terminals of the first electrical connector to mate with corresponding terminals of the second electrical connector; and wherein the mated terminals have substantially same electrical lengths and each terminal pair has a first terminal having a first longitudinal profile and a second terminal having a second longitudinal profile different than the first longitudinal profile and the combined longitudinal profiles of the mated terminals are configured to create the substantially same electrical lengths.

28. The electrical connector assembly according to claim 27, wherein each terminal pair of the first and second electrical connectors is configured to carry differential signals.

29. An electrical connector assembly comprising:

first and second electrical connectors for coupling to respective circuit boards, the first electrical connector having a first maximum height and the second electrical connector having a second maximum height, the first maximum height and the second maximum height being different, wherein each electrical connector comprises a plurality of terminal pairs, each terminal pair comprising terminals of different electrical lengths and each terminal pair has a first terminal having a first longitudinal profile and a second terminal having a second longitudinal profile different than the first longitudinal profile, the terminal pairs arranged in two rows in which the terminals of each terminal pair are offset from each other along a length direction of the rows, mating portions of the terminal pairs extending along a same direction that is substantially parallel to a width direction of the rows; and wherein the first and second electrical connectors are like connectors, and wherein the first electrical connector is stackable with the second electrical connector to form the electrical connector assembly, the electrical connector assembly having a maximum stack height less than a sum of the first and second maximum heights.

30. An electrical connector comprising:

a plurality of terminal pairs, each terminal pair arranged in two parallel rows in which the terminals of each pair are offset from each other along a length direction of the rows;

a plurality of ground shields, each ground shield interleaving adjacent terminals;

wherein each terminal pair is configured to mate with a complementary terminal pair of a like electrical connector to allow electrical signal transmission; and wherein each of the plurality of terminals comprises a terminal body having a terminating portion for connecting to a circuit board, a mating portion for mating to the complementary terminal of the like electrical connector, and a step portion joining the terminating portion to the mating portion, each terminal pair comprising a first terminal having a first mating portion with a first longitudinal profile and a second terminal having a second mating portion with a second longitudinal profile different from the first longitudinal profile, wherein the terminals of each terminal pair are at least partially housed in respective retention channels of the connector, the respective retention channels being arranged to overlap partially with each other, wherein the mating portions of the terminal pairs extend along a same direction that is substantially parallel to a width direction of the rows.

31. The electrical connector according to any of claim 30, wherein a stack height of the electrical connector is less than 4 mm.

32. The electrical connector according to claim 31, wherein the stack height of the electrical connector is less than 1 mm.

33. The electrical connector according to any of claim 30, wherein the electrical connector is a board-to-board connector.

34. An electrical connector comprising:

a first set of terminal pairs arranged along a first row and a second set of terminal pairs arranged along a second row, wherein terminals of each terminal pair are offset from each other along a length direction of the rows, each terminal of the first set of terminals of the second row along a length direction of the rows, each terminal of the first set of terminals having a first mating portion with a first longitudinal profile and each terminal of the second set of terminals having a second mating portion with a second longitudinal profile different from the first longitudinal profile, the first mating portion and the second mating portion extending along a same direction that is substantially parallel to a width direction of the rows;

wherein each terminal is configured to mate with a complementary terminal of a like electrical connector to allow electrical signal transmission, and wherein the first set of terminals and the second set of terminals are at least partially housed in respective retention channels of the connector, the respective retention channels being arranged to overlap partially with each other.

* * * * *